US009925807B2

(12) United States Patent
Iesaki

(10) Patent No.: US 9,925,807 B2
(45) Date of Patent: Mar. 27, 2018

(54) CONVEYANCE SYSTEM, SHEET PROCESSING SYSTEM, AND CONTROLLER

(71) Applicant: Brother Kogyo Kabushiki Kaisha, Nagoya-shi, Aichi-ken (JP)

(72) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/280,555

(22) Filed: Sep. 29, 2016

(65) Prior Publication Data

US 2017/0087898 A1 Mar. 30, 2017

(30) Foreign Application Priority Data

Sep. 30, 2015 (JP) ..... 2015-193854

(51) Int. Cl.
*B41J 13/00* (2006.01)
*B41J 29/393* (2006.01)
(Continued)

(52) U.S. Cl.
CPC ..... *B41J 13/0009* (2013.01); *B41J 11/42* (2013.01); *B41J 11/44* (2013.01); *B41J 13/0027* (2013.01); *B41J 13/02* (2013.01); *B41J 29/393* (2013.01); *B65H 5/062* (2013.01); *B65H 7/00* (2013.01); *B65H 7/06* (2013.01); *B65H 2404/143* (2013.01); *B65H 2515/31* (2013.01); *B65H 2515/32* (2013.01); *B65H 2553/51* (2013.01)

(58) Field of Classification Search
CPC . B41J 13/02; B41J 14/16; B41J 29/393; B41J 11/42; B41J 11/44; B41J 13/0027; B65H 7/06; B65H 5/062; B65H 5/06; B65H 7/20; B65H 2301/4474; B65H 2404/143; B65H 2515/31; B65H 2515/32; B65H 2553/51; B32B 27/34; B32B 27/322; B32B 27/08; B32B 2457/08; H05K 1/036; Y10T 428/31544; Y10T 428/3154
See application file for complete search history.

(56) References Cited

U.S. PATENT DOCUMENTS 8,876,241 B2 11/2014 Iesaki
9,382,084 B2 7/2016 Iesaki
(Continued)

FOREIGN PATENT DOCUMENTS

JP H07-054057 A 2/1995
JP 2014-196184 A 10/2014
JP 2014-197319 A 10/2014

*Primary Examiner* — Julian Huffman
(74) *Attorney, Agent, or Firm* — Banner & Witcoff, Ltd.

(57) ABSTRACT

There is provided a conveyance system including a plurality of rollers, a plurality of motors, a plurality of measuring devices, and a controller. The controller is configured to carry out the processes of: determining a control input on each of the plurality of motors, inputting a drive signal according to the control input, calculating an estimated reaction force value for each of the rollers, calculating an estimated tension value for each pair of the adjacent rollers, calculating a tension control input for each pair, and calculating a state control input on a particular one of the rollers. The controller determines the control input on each of the plurality of motors based on the tension control input for each pair and the state control input on the particular roller.

9 Claims, 16 Drawing Sheets

(51) Int. Cl.

| | |
|---|---|
| ***B41J 13/02*** | (2006.01) |
| ***B41J 11/44*** | (2006.01) |
| ***B41J 11/42*** | (2006.01) |
| ***B65H 7/06*** | (2006.01) |
| ***B65H 5/06*** | (2006.01) |
| ***B65H 7/00*** | (2006.01) |

(56) References Cited

U.S. PATENT DOCUMENTS

| | | | | |
|---|---|---|---|---|
| 2014/0291926 | A1 | 10/2014 | Iesaki | |
| 2014/0292874 | A1* | 10/2014 | Iesaki | B41J 13/0009 347/16 |
| 2014/0295189 | A1 | 10/2014 | Hidaka et al. | |

* cited by examiner

CONVEYANCE SYSTEM, SHEET PROCESSING SYSTEM, AND CONTROLLER

CROSS REFERENCE TO RELATED APPLICATION

The present application claims priority from Japanese Patent Application No. 2015-193854 filed on Sep. 30, 2015, the disclosure of which is incorporated herein by reference in its entirety.

BACKGROUND

Field of the Invention

The present disclosure relates to a sheet conveyance system, and controller controlling the sheet conveyance.

Description of the Related Art

Conventionally, there are known conveyance systems including a plurality of rollers along a sheet conveyance path to convey sheets with the plurality of rotating rollers. Controlling the sheet conveyance is realized by controlling a motor used commonly or a plurality of motors each provided for one single roller to drive the plurality of rollers. Such a conveyance system is mounted in, for example, an image formation system such as an ink jet printer or the like.

There are also known systems conveying sheets while controlling a tension of the sheets, in order to prevent images formed on the sheets from the decrease in quality because a flexure of the sheets changes to give rise to deviation of landing points of ink droplets.

However, for the systems conveying the sheets with the plurality of rotating rollers, techniques have not yet been developed sufficiently for accurately realizing both the control of a state quantity related to motion such as the position, speed and the like of the sheets, and the control of the sheet tension.

SUMMARY

According to an aspect of the present disclosure, it is desirable to be able to provide a new technique for a system transporting a sheet or sheets with a plurality of rotating rollers to be capable of appropriately controlling both the tension of the sheets and the state quantity of the sheets.

According to one aspect of the present disclosure, a conveyance system includes a plurality of rollers for conveying a sheet, a plurality of motors, a plurality of measuring devices, and a controller. The plurality of rollers are arranged apart from each other along a conveyance path for the sheet.

The plurality of motors are provided to correspond respectively to the plurality of rollers. Each of the plurality of motors is configured to rotationally drive the corresponding one roller among the plurality of rollers. The plurality of measuring devices are provided to correspond respectively to the plurality of rollers. Each of the plurality of measuring devices is configured to measure a state quantity related to a rotating motion of the corresponding one roller among the plurality of rollers.

The controller is configured to control, via the plurality of motors, an operation of conveying the sheet by rotations of the plurality of rollers.

According to one aspect of the present disclosure, the controller may be configured to carry out, as follows, a determination process, a drive control process, a reaction force estimation process, a tension estimation process, a first control input computation process, and a second control input computation process.

The determination process is configured to determine a control input on each of the plurality of motors. The drive control process is configured to input a drive signal according to the control input determined in the determination process to each of the plurality of motors. The reaction force estimation process is configured to calculate, for each of the rollers, an estimated reaction force value which is an estimated value of a reaction force acting on the roller, based on the state quantity measured by the measuring device corresponding to the roller among the plurality of measuring devices, and the control input on the roller determined in the determination process.

The tension estimation process is configured to calculate, for each pair of adjacent rollers among the plurality of rollers, an estimated tension value which is an estimated value of a sheet tension exerted on the pair, based on the estimated reaction force value for the pair. The first control input computation process is configured to calculate, for each pair, a tension control input which is a control input for controlling the sheet tension exerted on the pair under a target tension, based on a deviation between the target tension and the estimated tension value for the pair. The second control input computation process is configured to calculate a state control input which is a control input for controlling the state quantity of one predetermined particular roller under a target state quantity, among the plurality of rollers, based on the target state quantity and the state quantity measured by the measuring device corresponding to the particular roller among the plurality of measuring devices.

In the determination process, the controller determines the control input on each of the plurality of motors based on the tension control input for each pair calculated in the first control input computation process, and the state control input on the particular roller calculated in the second control input computation process.

According to the above conveyance system, when the sheet is conveyed by rotations of the plurality of rollers, the state quantity is controlled with a focus on the particular roller, while the other rollers than the particular roller are controlled via the control of the sheet tension. Therefore, it is possible to appropriately control both the sheet state quantity and the sheet tension with high precision. Accordingly, with the conveyance system according to one aspect of the present disclosure, it is possible, for example, to realize a conveyance control with diminished flexure of the sheet. The plurality of rollers may be two or more than two. With three rollers or more, there are a plurality of spaces between the adjacent rollers. In this case, with the conveyance system according to one aspect of the present disclosure, it is possible to control the tensions between the plurality of rollers based on individual target tensions. Therefore, even if there is difference in nip force between the respective rollers, it is still possible to realize the preferable transport control.

DESCRIPTION OF THE EMBODIMENTS

Referring to the accompanying drawings, exemplary embodiments of the present disclosure will be explained hereinbelow.

First Embodiment

Figure 1:
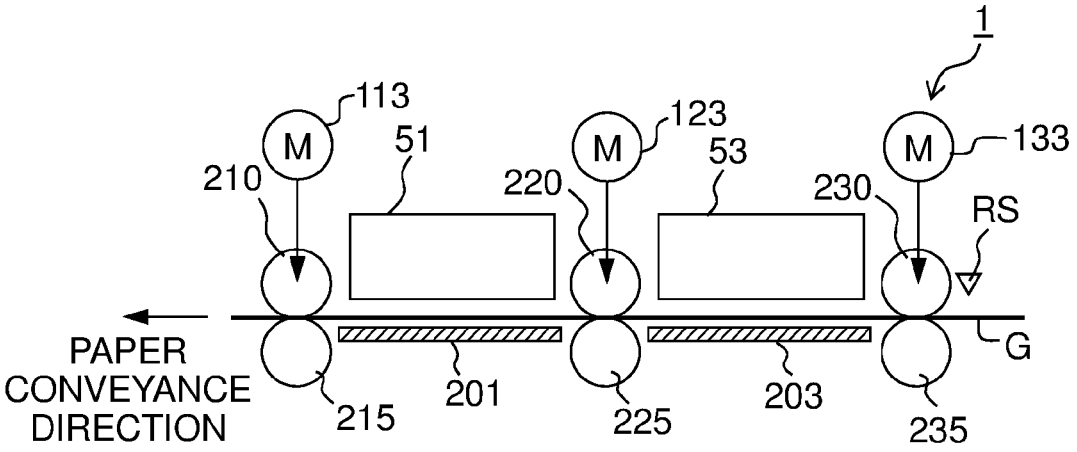
FIG. 1 is a diagram showing a configuration of a periphery of a paper conveyance path in an image formation system according to a first embodiment of the present invention.

An image formation system 1 according to a first embodiment is configured as an ink jet printer to form image on paper G by jetting ink droplets. This image formation system 1 includes, as depicted in FIG. 1, a plurality of processing heads 51 and 53 arranged along a conveyance path for the paper G.

The processing heads 51 and 53 jet liquid droplets of mutually different types. According to one example, the processing heads 51 and 53 jet ink droplets of mutually different colors onto the paper G. For example, one of the processing heads 51 and 53 is an ink jet head jetting ink droplets of cyan, magenta and yellow onto the paper G, while the other is an ink jet head jetting ink droplets of black onto the paper G. In this case, color image is formed from those four color inks on the paper G through a process for the processing head 53 to jet the ink droplets onto the paper G and another process for the processing head 51 to jet the ink droplets onto the paper G.

According to another example, the processing head 51 is an ink jet head adapted to jet ink droplets onto the paper G, while the processing head 53 is a head located on the upstream side from the processing head 51 in the paper conveyance path to jet a transparent pretreatment liquid (a precoat liquid) onto the paper G for improving the retention quality of the inks. In this case, color or black-and-white image is formed on the paper G through a process for the processing head 53 to jet precoat liquid droplets onto the paper G and another process for the processing head 51 to jet ink droplets onto the paper G.

These processing heads 51 and 53 have a shape elongated in a line direction (the normal direction of FIG. 1) orthogonal to a paper conveyance direction, and are capable of jetting liquid droplets onto the entire area, in the line direction, of the paper G passing thereunder.

Currently widespread ink jet printers form image on the paper G by repeating an operation of transporting the processing heads 51 and 53 in the line direction on each occasion of conveying the paper G by a predetermined length. In contrast to this, the image formation system 1 in the first embodiment does not intermittently convey the paper G but, with the paper G being conveyed at constant speed, causes the elongated processing heads 51 and 53 to jet the liquid droplets. In this manner, image is formed on the paper G. The image formation system 1 in the first embodiment differs from those currently widespread ink jet printers in that the paper G is conveyed at constant speed while the liquid droplets are jetted to form image on the paper G.

In the image formation system 1, the paper G is conveyed from upstream to downstream through the paper conveyance path by rotations of a first roller 210, a second roller 220, and a third roller 230. The first roller 210, the second roller 220 and the third roller 230 are arranged apart from each other in the present order along the paper conveyance path, from downstream toward upstream of the paper conveyance path.

The paper conveyance path includes platens 201 and 203 to constitute the conveyance path for the paper G by supporting the paper G from below. The platen 201 is arranged below the processing head 51 provided between the first roller 210 and the second roller 220, while the platen 203 is arranged below the processing head 53 provided between the second roller 220 and the third roller 230.

The first roller 210 is provided on the downstream side from the platen 201 and arranged to face a first driven roller 215. The second roller 220 is provided on the upstream side from the platen 201 but on the downstream side from the platen 203, and arranged to face a second driven roller 225. The third roller 230 is provided on the upstream side from the platen 203 and arranged to face a third driven roller 235. The third driven roller 235 is a rubber roller while the first driven roller 215 and the second driven roller 225 are spur rollers. Therefore, the nip force of the third roller 230 and third driven roller 235 is larger than the nip force of the first roller 210 and first driven roller 215, and larger than the nip force of the second roller 220 and second driven roller 225. In other words, the conveyance force of the third roller 230 is larger than the conveyance force of the first roller 210, and larger than the conveyance force of the second roller 220.

The first roller 210 conveys the paper G downstream by rotating while nipping the paper G between itself and the first driven roller 215. The first roller 210 is driven to rotate by a first motor 113 which is a DC motor. The second roller 220 conveys the paper G downstream toward the nip position at the first roller 210 by rotating while nipping the paper G between itself and the second driven roller 225. The second roller 220 is driven to rotate by a second motor 123 which is another DC motor similar to the first motor 113. The third roller 230 conveys the paper G downstream toward the nip position at the second roller 220 by rotating while nipping the paper G between itself and the third driven roller 235. The third roller 230 is driven to rotate by a third motor 133 which is still another DC motor similar to the first motor 113.

The first roller 210, the second roller 220 and the third roller 230 are arranged at such intervals that the length of the paper G in the conveyance direction is longer than the distance along the paper conveyance path between the most downstream first roller 210 and the most upstream third roller 230. Therefore, the paper G is nipped at three places apart in the paper conveyance direction by the first roller 210, the second roller 220 and the third roller 230, and is conveyed downstream by the rotations of these three rollers 210, 220 and 230.

Although the anterior end of the paper G arrives in order at the third roller 230, the second roller 220 and the first roller 210 to be conveyed downstream by the rotations of those rollers, in order to convey the paper G at constant speed, the first motor 113, the second motor 123 and the third motor 133 start simultaneously to drive the first roller 210, the second roller 220 and the third roller 230 to rotate.

Figure 2:
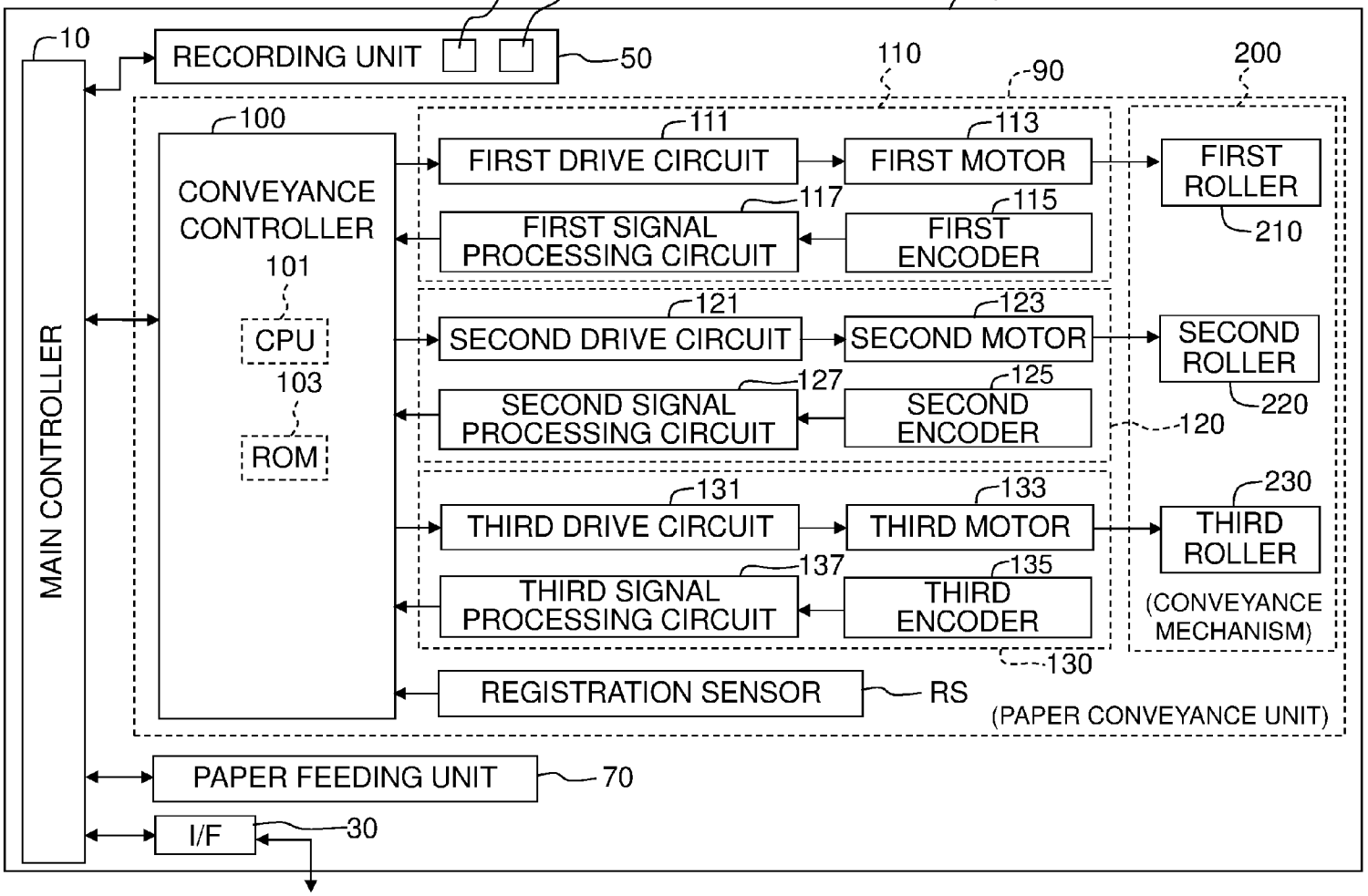
FIG. 2 is a block diagram showing an overall configuration of the image formation system.

Next, a detailed configuration of the image formation system 1 will be explained. As depicted in FIG. 2, the image formation system 1 includes a main controller 10, a communication interface 30, a recording unit 50, a paper feeding unit 70, and a paper conveyance unit 90. A conveyance mechanism 200 for the paper G is provided in the paper conveyance unit 90 to include the abovementioned three rollers 210, 220 and 230, the opposed driven rollers 215, 225 and 235, and the platens 201 and 203.

The main controller 10 includes an undepicted microcomputer and the like to overall control the image formation system 1. The communication interface 30 realizes communications between the main controller 10 and an external device (a personal computer and the like). The main controller 10 controls the recording unit 50, the paper feeding unit 70 and the paper conveyance unit 90, so as to receive image data as a print target from the external device via the communication interface 30, and form the image on the paper G based on the image data of the print target.

The recording unit 50 includes the abovementioned processing heads 51 and 53, and their drive circuits (not depicted). Following instructions from the main controller 10, the recording unit 50 drives the processing heads 51 and 53 to form the image on the paper G based on the image data of the print target.

The paper feeding unit 70 supplies the paper G to the most upstream roller (the third roller 230) included in the conveyance mechanism 200, in the paper conveyance path. The paper feeding unit 70 includes a motor, a paper feed roller, a paper feed tray and a paper feed path all of which are not depicted. Following instructions from the main controller 10, the paper feeding unit 70 supplies the paper G to the most upstream roller (the third roller 230) of the conveyance mechanism 200.

In addition to the conveyance mechanism 200 mentioned above, the paper conveyance unit 90 includes a conveyance controller 100, a first control element group 110 for controlling the drive of the first roller 210, a second control element group 120 for controlling the drive of the second roller 220, a third control element group 130 for controlling the drive of the third roller 230, and a registration sensor RS. Further, the first control element group 110 is used for the first roller 210, the second control element group 120 is used for the second roller 220, and the third control element group 130 is used for the third roller 230. Except for this feature, the first control element group 110, the second control element group 120, and the third control element group 130 have basically the same configuration.

The first control element group 110 includes a first drive circuit 111, the first motor 113, a first encoder 115, and a first signal processing circuit 117. The first drive circuit 111 is such a circuit for driving the first motor 113 that following a PWM signal input from the conveyance controller 100, the first drive circuit 111 applies a drive current corresponding to the duty ratio of the PWM signal to the first motor 113 to drive the same.

The first encoder 115 is a rotary encoder adapted to output a pulse signal corresponding to the rotation of the first roller 210. The first encoder 115 is provided in such a position as capable of directly or indirectly observing the rotating motion of the first roller 210. For example, the first encoder 115 is arranged on the rotary shaft of the first roller 210 or on the rotary shaft of the first motor 113. In the same manner as a well-known incremental rotary encoder, the first encoder 115 outputs an A-phase signal and a B-phase signal different in phase as the pulse signal mentioned above. Hereinbelow, those signals will be expressed collectively as an encoder signal.

The encoder signal output from the first encoder 115 is input to the first signal processing circuit 117. Based on the input encoder signal, the first signal processing circuit 117 measures rotation amount X[1] and rotation speed V[1] of the first roller 210, and inputs the measured information of the rotation amount X[1] and rotation speed V[1] to the conveyance controller 100.

The second control element group 120 includes a second drive circuit 121, the second motor 123, a second encoder 125, and a second signal processing circuit 127. Following a PWM signal input from the conveyance controller 100, the second drive circuit 121 applies the corresponding drive current to the second motor 123 to drive the same.

The second encoder 125 is provided in such a position as capable of directly or indirectly observing the rotating motion of the second roller 220 to output the encoder signal corresponding to the rotation of the second roller 220. The encoder signal output from the second encoder 125 is input to the second signal processing circuit 127. Based on the input encoder signal, the second signal processing circuit 127 measures rotation amount X[2] and rotation speed V[2] of the second roller 220, and inputs the measured information of the rotation amount X[2] and rotation speed V[2] to the conveyance controller 100.

The third control element group 130 includes a third drive circuit 131, the third motor 133, a third encoder 135, and a third signal processing circuit 137. Following a PWM signal input from the conveyance controller 100, the third drive circuit 131 applies the corresponding drive current to the third motor 133 to drive the same.

The third encoder 135 is provided in such a position as capable of directly or indirectly observing the rotating motion of the third roller 230 to output the encoder signal corresponding to the rotation of the third roller 230. The encoder signal output from the third encoder 135 is input to the third signal processing circuit 137. Based on the input encoder signal, the third signal processing circuit 137 measures rotation amount X[3] and rotation speed V[3] of the third roller 230, and inputs the measured information of the rotation amount X[3] and rotation speed V[3] to the conveyance controller 100.

The registration sensor RS detects the passage of the paper G. As depicted in FIG. 1, the registration sensor RS is provided in the upstream vicinity of the most upstream roller (the third roller 230) of the conveyance mechanism 200, to input, to the conveyance controller 100, a signal indicating that the paper G has passed that point.

The conveyance controller 100 controls the feedback to the first motor 113, the second motor 123 and the third motor 133, based on the inputs from the first signal processing circuit 117, the second signal processing circuit 127 and the third signal processing circuit 137.

In particular, the conveyance controller 100 calculates a control input on the first motor 113, a control input on the second motor 123, and a control input on the third motor 133, and inputs the PWM signals corresponding to those control inputs, respectively, to the corresponding first drive circuit 111, second drive circuit 121 and third drive circuit 131. By inputting those PWM signals, the conveyance controller 100 controls the first motor 113, the second motor 123 and the third motor 133 and, furthermore, controls the operation of transporting the paper G by the rotations of the first roller 210, the second roller 220 and the third roller 230.

According to the first embodiment, the conveyance controller 100 controls the first motor 113, the second motor 123, and the third motor 133 such that the paper G may be conveyed at constant speed and may pass below the processing heads 51 and 53 in a state of having an appropriate tension.

If supposedly the control is carried out without considering the tension, then due to some control error, the paper G may bend or flex between the first roller 210 and the second roller 220 and between the second roller 220 and the third roller 230. Moreover, because the flexure is not invariable, variation will occur in the distance between the processing heads 51 and 53 and the surface of the paper G. If such distance variation occurs, then on the paper G, the landing points of the liquid droplets jetted from the processing heads 51 and 53 will deviate from the assumed positions. If the landing points deviate in this manner, then adverse effect will be exerted on the quality of the image formed on the paper G. For this reason, the conveyance controller 100 takes into account the speed and the tension of the paper G for controlling the first motor 113, the second motor 123, and the third motor 133.

Figure 3:
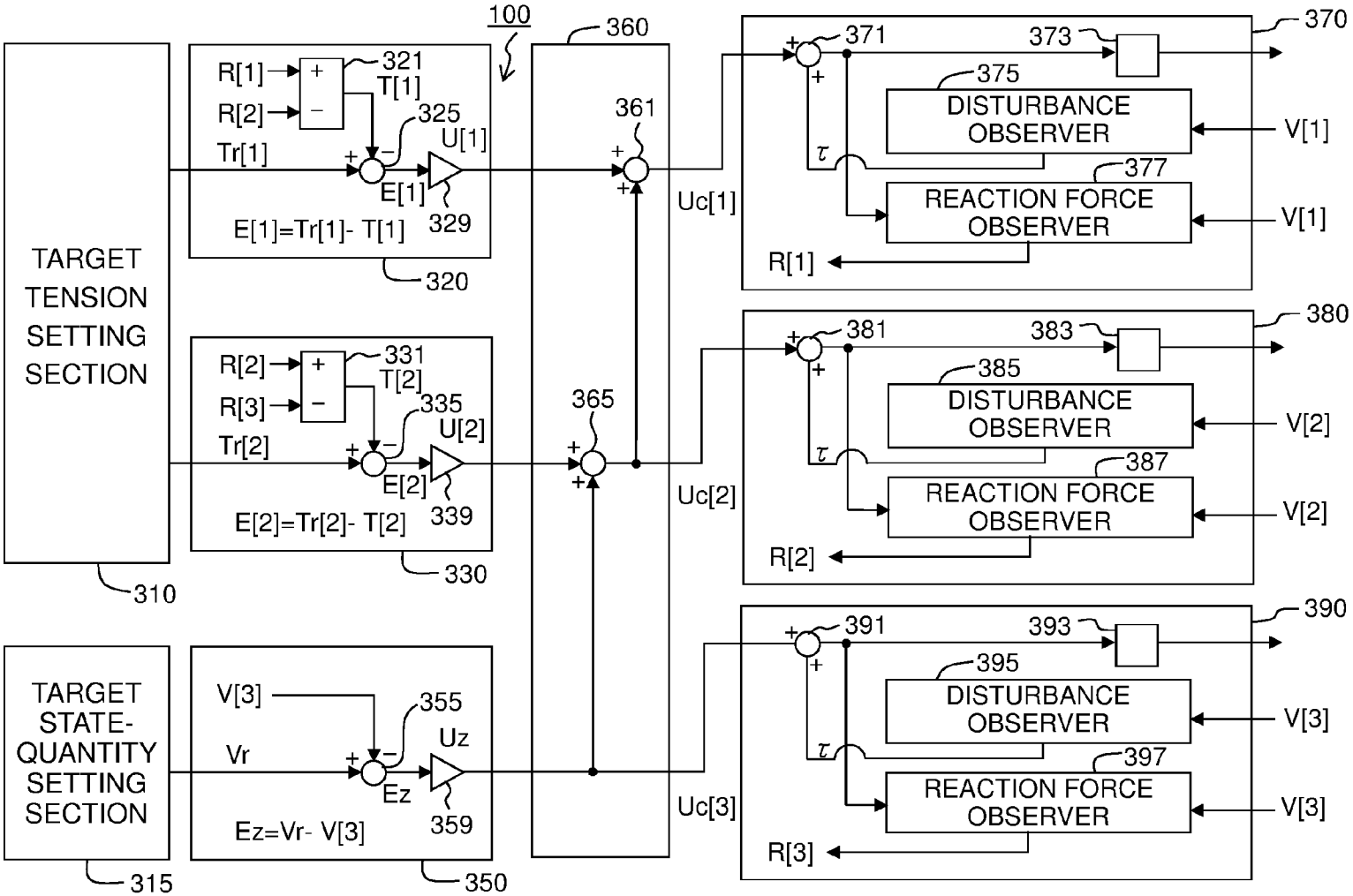
FIG. 3 is a block diagram showing a detailed configuration of a conveyance controller according to the first embodiment.

Next, a detailed configuration of the conveyance controller 100 will be explained. As depicted in FIG. 3, the conveyance controller 100 includes a target tension setting section 310, a target state quantity setting section 315, a first tension control input computation section 320, a second tension control input computation section 330, a state control input computation section 350, a conversion section 360, a first motor controller 370, a second motor controller 380, and a third motor controller 390.

The target tension setting section 310 sets the first tension control input computation section 320 with a target tension Tr[1] for the paper tension exerted on the first roller 210 and the second roller 220, and sets the second tension control input computation section 330 with a target tension Tr[2] for the paper tension exerted on the second roller 220 and the third roller 230. The target state quantity setting section 315 sets the state control input computation section 350 with a target speed Vr. The target speed Vr corresponds to the conveyance speed for the paper G.

The first tension control input computation section 320 includes an estimated tension value calculation section 321, a deviation calculation section 325, and a control input calculation section 329. The estimated tension value calculation section 321 calculates the estimated tension value T[1]=R[1]−R[2] based on an estimated reaction force value R[1] and another estimated reaction force value R[2].

The estimated reaction force value R[1] is an estimated value of the reaction force acting on the first roller 210, obtained from the first motor controller 370, while the estimated reaction force value R[2] is an estimated value of the reaction force acting on the second roller 220, obtained from the second motor controller 380. The estimated tension value T[1] corresponds to an estimated value of the difference in the paper tension exerted on the first roller 210 and the second roller 220. The target tension Tr[1] represents the target value for the estimated tension value T[1].

The deviation calculation section 325 calculates the deviation E[1]=Tr[1]−T[1] between the target tension Tr[1] and the estimated tension value T[1] obtained from the estimated tension value calculation section 321.

The control input calculation section 329 calculates a tension control input U[1] based on the deviation E[1] obtained from the deviation calculation section 325. The tension control input U[1] is a control input for controlling the difference between the tensions exerted on the pair of the first roller 210 and second roller 220, under the target tension Tr[1]. The control input calculation section 329 is configured to as, for example, a proportioning controller. In this case, the control input calculation section 329 exerts a predetermined gain Kt on the deviation E[1], and calculates the tension control input U[1]=Kt·E[1]. The calculated tension control input U[1] is input to the conversion section 360.

The second tension control input computation section 330 includes an estimated tension value calculation section 331, a deviation calculation section 335, and a control input calculation section 339. The estimated tension value calculation section 331 calculates the estimated tension value T[2]=R[2]−R[3] based on the estimated reaction force value R[2] and an estimated reaction force value R[3]. The estimated reaction force value R[3] is an estimated value of the reaction force acting on the third roller 230, obtained from the third motor controller 390. The estimated tension value T[2] corresponds to an estimated value of the difference in the paper tensions exerted on the second roller 220 and the third roller 230. The target tension Tr[2] represents the target value for the estimated tension value T[2].

The deviation calculation section 335 calculates the deviation E[2]=Tr[2]−T[2] between the target tension Tr[2] and the estimated tension value T[2] obtained from the estimated tension value calculation section 331.

The control input calculation section 339 calculates a tension control input U[2] based on the deviation E[2] obtained from the deviation calculation section 335. The tension control input U[2] is a control input for controlling the difference between the tensions exerted on the pair of the second roller 220 and third roller 230, under the target tension Tr[2]. The control input calculation section 339 is configured to as, for example, another proportioning controller. In this case, the control input calculation section 339 exerts the predetermined gain Kt on the deviation E[2], and calculates the tension control input U[2]. The calculated tension control input U[2] is input to the conversion section 360.

The state control input computation section 350 includes a deviation calculation section 355 and a control input calculation section 359. The deviation calculation section 355 calculates the deviation Ez=Vr−V[3] between the target speed Vr and the rotation speed V[3] (measured value) of the third roller 230 predetermined as a speed control object roller. The rotation speed V[3] is obtainable from the third signal processing circuit 137.

The control input calculation section 359 calculates a state control input Uz based on the deviation Ez obtained from the deviation calculation section 355. The state control input Uz is a control input for controlling the rotation speed V[3] of the speed control object roller and, furthermore, the conveyance speed for the paper G, under the target speed Vr.

The control input calculation section 359 is configured to as, for example, still another proportioning controller. In this case, the control input calculation section 359 exerts a predetermined gain Kz on the deviation Ez, and calculates the state control input Uz. The calculated state control input Uz is input to the conversion section 360.

The conversion section 360 calculates control inputs Uc[1], Uc[2] and Uc[3] on the motors, respectively, based on the tension control input U[1] input from the first tension control input computation section 320, the tension control input U[2] input form the second tension control input computation section 330, and the state control input Uz input from the state control input computation section 350. The control input Uc[1] is a control input on the first motor 113, the control input Uc[2] is a control input on the second motor 123, and the control input Uc[3] is a control input on the third motor 133.

In particular, the conversion section 360 includes a first computation section 361 and a second computation section 365. The first computation section 361 calculates the control input Uc[1] on the first motor 113, following the relational expression Uc[1]=U[1]+U[2]+U[3]. The second computation section 365 calculates the control input Uc[2] on the second motor 123, following the relational expression Uc[2]=U[2]+U[3].

The conversion section 360 inputs the control input Uc[1] calculated in the above manner to the first motor controller 370, and inputs the control input Uc[2] to the second motor controller 380. Further, the conversion section 360 inputs the state control input Uz as the control input Uc[3] on the third motor 133 which is the motor of the speed control object, to the third motor controller 390.

The first motor controller 370 includes a correction section 371, a PWM signal generator 373, a disturbance observer 375, and a reaction force observer 377. The correction section 371 corrects the input control input Uc[1], based on an estimated disturbance value τ input from the disturbance observer 375, and outputs the corrected control input Uc*[1]=Uc[1]+τ. The PWM signal generator 373 converts the corrected control input Uc*[1] into a PWM signal having the corresponding duty ratio, and outputs the same. The output PWM signal is input to the first drive circuit 111 to drive the first motor 113 with the drive current corresponding to the control input Uc*[1].

The disturbance observer 375 calculates the estimated disturbance value τ based on the corrected control input Uc*[1] on the first motor 113, and the rotation speed V[1] of the first roller 210 measured by the first signal processing circuit 117.

The reaction force observer 377 estimates the reaction force acting on the first roller 210 and outputs the estimated reaction force value R[1], based on the corrected control input Uc*[1] on the first motor 113 and the rotation speed V[1] of the first roller 210 measured by the first signal processing circuit 117. The estimated reaction force value R[1] corresponds to the paper tension exerted on the first roller 210.

Figure 4:
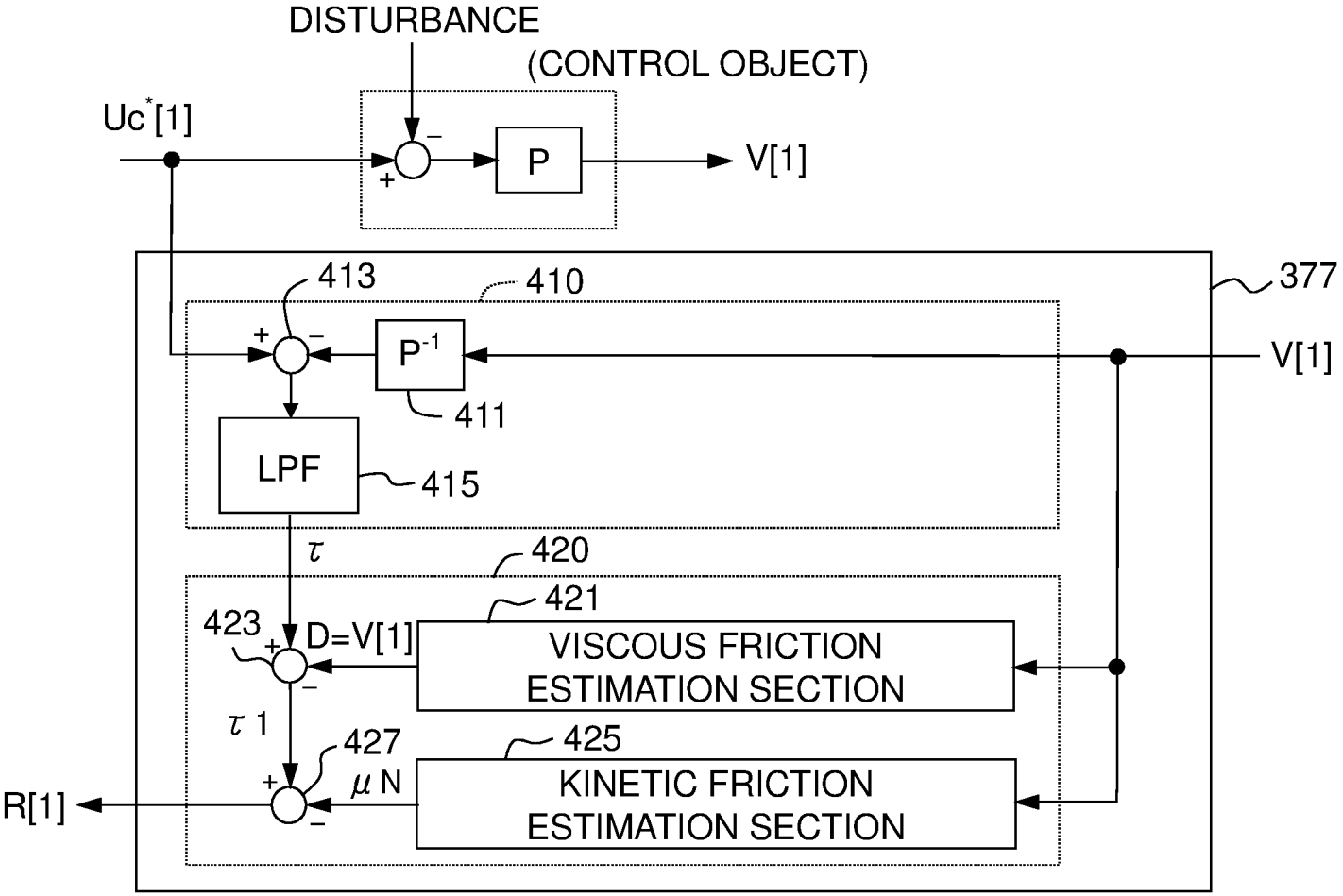
FIG. 4 is a block diagram showing a configuration of a reaction force observer.

As depicted in FIG. 4, the reaction force observer 377 includes a disturbance observer 410 and a reaction force estimation section 420. The disturbance observer 410 has the same configuration as the disturbance observer 375. The disturbance observer 410 includes an inverse model computation section 411, a subtractor 413, and a low-pass filter 415.

The inverse model computation section 411 uses a transmission function $P^{-1}$ of an inverse model to a transmission model of the control object to convert the rotation speed V[1] measured by the first signal processing circuit 117 into the corresponding control input Um. The transmission model of the control object corresponds to a transmission function P which models the transmission system from the input of the PWM signal corresponding to the control input Uc*[1] to the measurement of the rotation speed V[1].

The subtractor 413 calculates the deviation (Uc*[1]−Um) between the control input Uc*[1] on the first motor 113 and the control input Um calculated by the inverse model computation section 411. The low-pass filter 415 eliminates high-frequency contents from the deviation (Uc*[1]−Um). The disturbance observer 410 outputs, as the estimated disturbance value τ, the deviation (Uc*[1]−Um) from which the high-frequency contents are eliminated by the low-pass filter 415.

The deviation (Uc*[1]−Um) is in amperes because the control input Uc[1] is a current command value. Further, if the drive source is a DC motor, then a proportional relation is established between ampere and torque (reaction force). Therefore, the deviation (Uc*[1]−Um) indirectly represents the force as a disturbance acting on the control object.

Based on the estimated disturbance value τ, the reaction force estimation section 420 estimates the reaction force due to the tension of the paper G. The estimated disturbance value τ includes not only a reaction force component caused by the tension but also a viscous friction component and a kinetic friction component arising from the rotation. Therefore, the reaction force estimation section 420 calculates the estimated reaction force value R[1] by eliminating the viscous friction component and the kinetic friction component from the estimated disturbance value τ.

In particular, the reaction force estimation section 420 includes a viscous friction estimation section 421 and a subtractor 423. The viscous friction estimation section 421 sets an estimated value of viscous friction force at the value (D×V[1]) of multiplying the rotation speed V[1] of the first roller 210 measured by the first signal processing circuit 117 by a predetermined coefficient D. The subtractor 423 calculates the estimated disturbance value τ1=(τ−D×V[1]) after the viscous friction component is eliminated, by subtracting the estimated value of the viscous friction force (D×V[1]) from the estimated disturbance value τ.

The reaction force estimation section 420 further includes a kinetic friction estimation section 425 and a subtractor 427. The kinetic friction estimation section 425 sets the estimated value of the kinetic friction force to zero if the rotation speed V[1] of the first roller 210 is zero, measured by the first signal processing circuit 117, but sets the estimated value of the kinetic friction force to a predetermined nonzero value μN if the rotation speed V[1] of the first roller 210 is not zero, measured by the first signal processing circuit 117.

The subtractor 427 subtracts, from the estimated disturbance value τ1, the estimated value of the kinetic friction force (zero or μN) set by the kinetic friction estimation section 425. The reaction force estimation section 420 outputs the value calculated by the subtractor 427 as the estimated value R[1] of the reaction force acting on the first roller 210.

The second motor controller 380 includes a correction section 381, a PWM signal generator 383, a disturbance observer 385, and a reaction force observer 387.

The correction section 381 corrects the input control input Uc[2] on the basis of the estimated disturbance value τ input from the disturbance observer 385, and outputs the corrected control input Uc*[2]=Uc[2]+τ. The PWM signal generator 383 converts the corrected control input Uc*[2] into a PWM signal having the corresponding duty ratio, and outputs the same. The output PWM signal is input to the second drive circuit 121 to drive the second motor 123 with the drive current corresponding to the control input Uc*[2].

The disturbance observer 385 calculates the estimated disturbance value τ based on the corrected control input Uc*[2] on the first motor 113, and the rotation speed V[2] measured by the second signal processing circuit 127. The reaction force observer 387 estimates the reaction force acting on the second roller 220 and outputs the estimated reaction force value R[2], based on the corrected control input Uc*[2] on the second motor 123 and the rotation speed V[2] of the second roller 220 measured by the second signal processing circuit 127. The estimated reaction force value R[2] corresponds to the paper tension exerted on the second roller 220.

The reaction force observer 387 has basically the same configuration as the reaction force observer 377. A detailed configuration of the reaction force observer 387 should be understood by replacing the first motor 113, the first roller 210, the first signal processing circuit 117, the control inputs Uc[1] and Uc*[1], the rotation speed V[1], and the estimated reaction force value R[1] in the above explanation on the reaction force observer 377, with the second motor 123, the second roller 220, the second signal processing circuit 127, the control inputs Uc[2] and Uc*[2], the rotation speed V[2], and the estimated reaction force value R[2], respectively in order.

The third motor controller 390 includes a correction section 391, a PWM signal generator 393, a disturbance observer 395, and a reaction force observer 397. The correction section 391 corrects the input control input Uc[3] on the basis of the estimated disturbance value τ input from the disturbance observer 395, and outputs the corrected control input Uc*[3]=Uc[3]+τ. The PWM signal generator 393 converts the corrected control input Uc*[3] into a PWM signal having the corresponding duty ratio, and outputs the same. The output PWM signal is input to the third drive circuit 131 to drive the third motor 133 with the drive current corresponding to the control input Uc*[3].

The disturbance observer 395 calculates the estimated disturbance value τ based on the corrected control input Uc*[3] on the third motor 133, and the rotation speed V[3] of the third roller 230 measured by the third signal processing circuit 137. The reaction force observer 397 estimates the reaction force acting on the third roller 230 and outputs the estimated reaction force value R[3], based on the corrected control input Uc*[3] on the third motor 133 and the rotation speed V[3] of the third roller 230 measured by the third signal processing circuit 137. The estimated reaction force value R[3] corresponds to the paper tension exerted on the third roller 230.

A detailed configuration of the reaction force observer 397 should be understood by replacing the first motor 113, the first roller 210, the first signal processing circuit 117, the control inputs Uc[1] and Uc*[1], the rotation speed V[1], and the estimated reaction force value R[1] in the above explanation on the reaction force observer 377, with the third motor 133, the third roller 230, the third signal processing circuit 137, the control inputs Uc[3] and Uc*[3], the rotation speed V[3], and the estimated reaction force value R[3], respectively in order.

Here, an explanation will be made on a principle for calculating the control inputs Uc[1], Uc[2] and Uc[3] on the respective motors, based on the tension control inputs U[1] and U[2], and the state control input Uz.

It is possible to represent, by the following formula, the estimated tension value T[i] (1≤i≤2) and the rotation speed V[3] of the third roller 230, using the estimated reaction force value R[j] and rotation speed V[j] of the jth roller (1≤j≤3).

$$\begin{bmatrix} T[1] \\ T[2] \\ V[3] \end{bmatrix} = A \cdot \begin{bmatrix} R[1] \\ R[2] \\ R[3] \end{bmatrix} + B \cdot \begin{bmatrix} V[1] \\ V[2] \\ V[3] \end{bmatrix} \quad \text{[Formula 4]}$$

$$A = \begin{bmatrix} 1 & -1 & 0 \\ 0 & 1 & -1 \\ 0 & 0 & 0 \end{bmatrix}, B = \begin{bmatrix} 0 & 0 & 0 \\ 0 & 0 & 0 \\ 0 & 0 & 1 \end{bmatrix}$$

Hence, it is possible to represent, by the following formula, a relationship between the tension control inputs U[1] and U[2] with the state control input Uz, and the control inputs Uc[1], Uc[2] and Uc[3] on the respective motors, using the inverse matrix $(A+B)^{-1}$ of the matrix (A+B).

$$\begin{bmatrix} Uc[1] \\ Uc[2] \\ Uc[3] \end{bmatrix} = (A+B)^{-1} \cdot \begin{bmatrix} U[1] \\ U[2] \\ Uz \end{bmatrix} \quad \text{[Formula 5]}$$

$$(A+B)^{-1} = \begin{bmatrix} 1 & 1 & 1 \\ 0 & 1 & 1 \\ 0 & 0 & 1 \end{bmatrix}$$

For such reasons, in the conversion section 360 as described above, the control inputs Uc[1], Uc[2] and Uc[3] on the respective motors are calculated from the tension control inputs U[1] and U[2], and the state control input Uz.

It is possible to determine the target tensions Tr[1] Tr[2], following the relational expressions Tr[1]=2·Tr12−Tr23 and Tr[2]=−Tr12+2·Tr23, based on the target value Tr12 of tension T12 of the paper G between the first roller 210 and the second roller 220, and the target value Tr23 of tension T23 of the paper G between the second roller 220 and the third roller 230.

Figure 5:
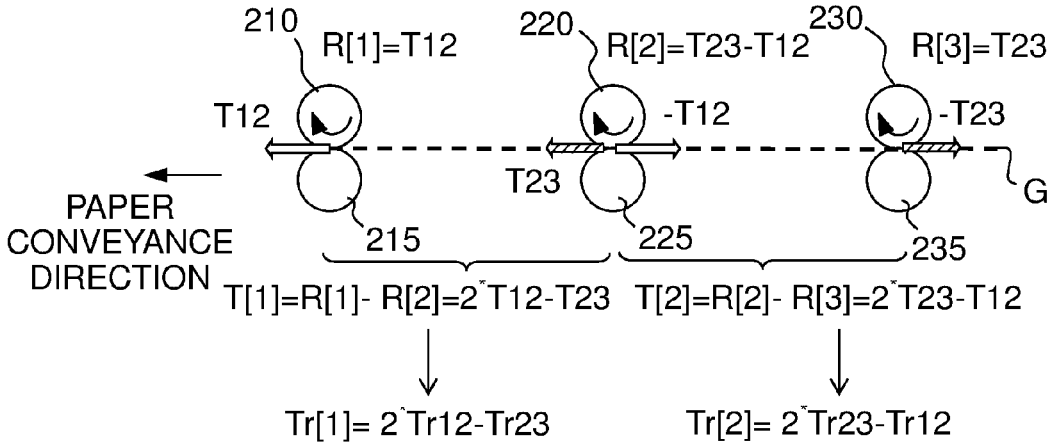
FIG. 5 is an explanatory diagram with respect to a method of setting a target tension.

That is because, as depicted in FIG. 5, the reaction force acting on the first roller 210 corresponds to the tension T12, the reaction force acting on the second roller 220 corresponds to the tension (T23−T12), and the reaction force R3 acting on the third roller 230 corresponds to the tension of −T23.

It is possible to determine the target values Tr12 and Tr23 of the tensions between the rollers, based on the nip force of each roller, such that the first roller 210, the second roller 220 and the third roller 230 may not slip on the paper G. It is possible to determine the target speed Vr based on the resolution and the like of the image to be on the paper G. It is possible to find appropriate values for those variables through experiments.

Using the predetermined target values Tr12 and Tr23 of the tensions between the rollers and following the above relational expressions, it is possible for the target tension setting section 310 to set the first tension control input computation section 320 with the target tension Tr[1], and to set the second tension control input computation section 330 with the target tension Tr[2].

However, when the paper G is not nipped by both the first roller 210 and the second roller 220, no paper tension arises between the first roller 210 and the second roller 220.

Therefore, it is possible to calculate the target tensions Tr[1] and Tr[2], with the target value Tr12 at zero. Likewise, when the paper G is not nipped by both the second roller 220 and the third roller 230, no paper tension arises between the second roller 220 and the third roller 230. Therefore, it is possible to calculate the target tensions Tr[1] and Tr[2], with the target value Tr23 at zero. It is possible to determine the position of the paper G based on the rotation amount of the roller from the point of time when the paper end is detected by the registration sensor RS.

FIGS. 6A and 6B, FIGS. 7A and 7B, and FIGS. 8A to 8C show some observed results when the paper G is conveyed by the image formation system 1 configured in the above manner. However, those observed results are obtained when the first motor 113, the second motor 123 and the third motor 133 start driving, in such a state that the anterior end of the paper G is positioned on the downstream side from the first roller 210 while the posterior end is positioned on the upstream side from the third roller 230 and, furthermore, the paper G is deliberately flexed between the first roller 210 and the second roller 220 and between the second roller 220 and the third roller 230.

Figure 6A:
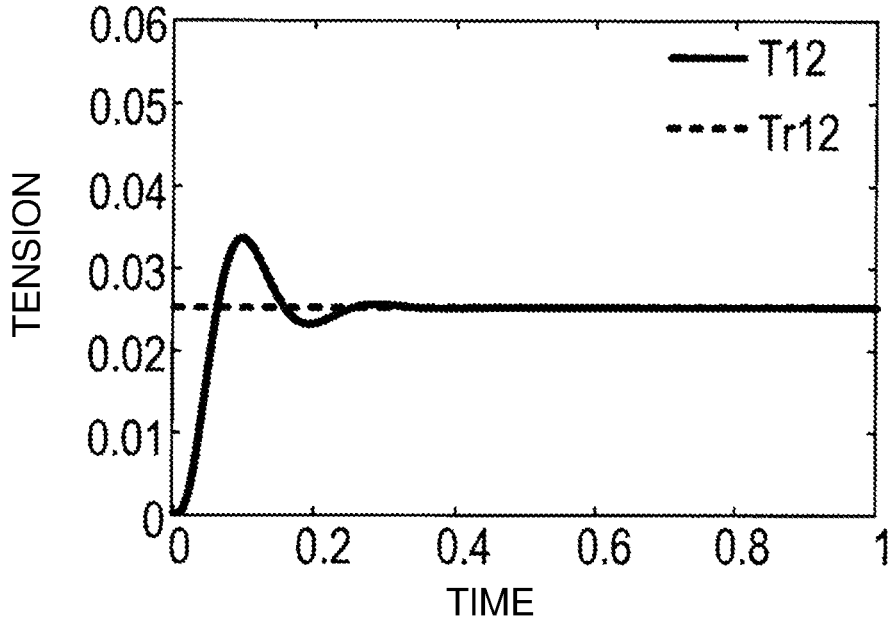
FIGS. 6A and 6B are graphs of tensions between rollers with respect to time.
Figure 6B:
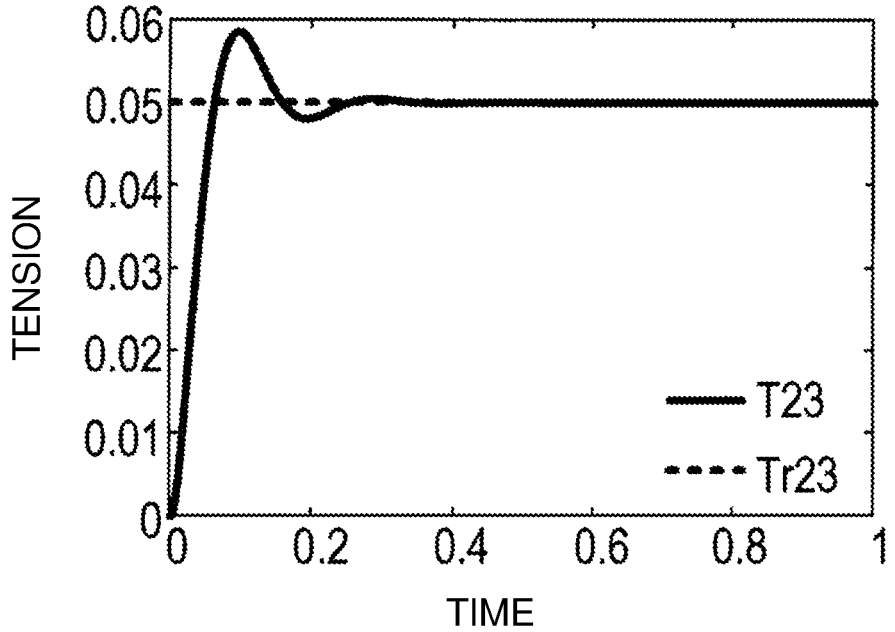
Figure 7A:
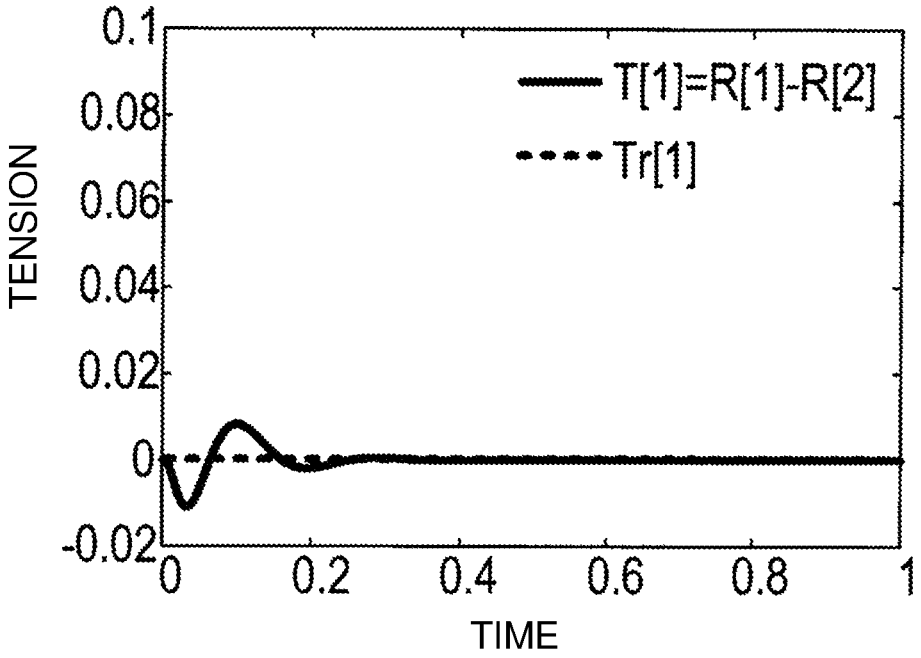
FIGS. 7A and 7B are graphs of estimated tension values with respect to time.
Figure 7B:
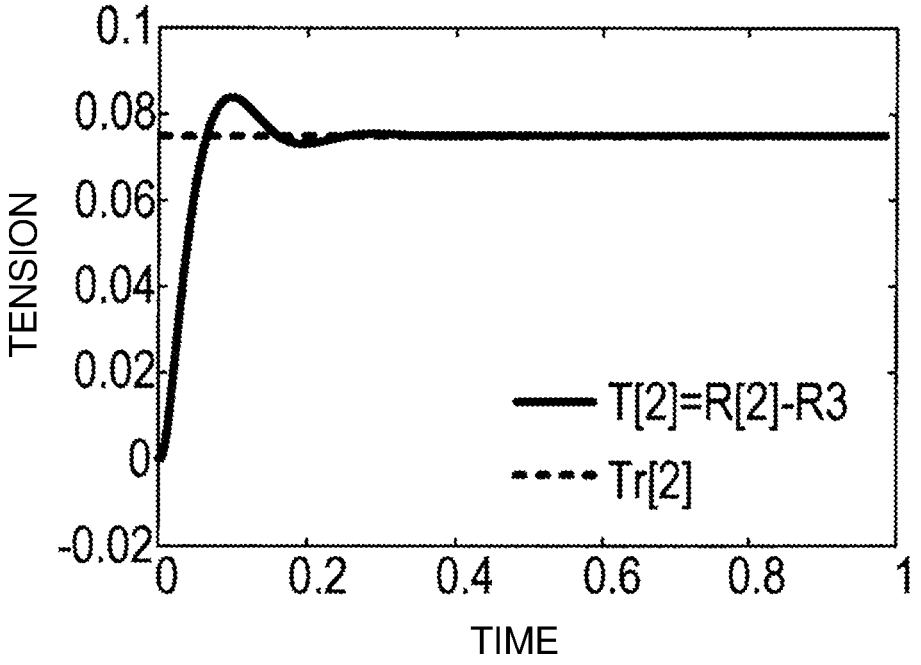

As understandable from FIGS. 6A and 6B, the tensions T12 and T23 between the rollers indicated with the solid lines in the graphs are adjusted in a short time by the target values Tr12 and Tr23 indicated with the broken lines and, thereafter, are maintained stably. Likewise, as understandable from FIGS. 7A and 7B, the estimated tension values T[1] and T[2] indicated with the solid lines in the graphs are adjusted in a short time by the target tensions Tr[1] and Tr[2] indicated with the broken lines and, thereafter, are maintained stably.

Figure 8A:
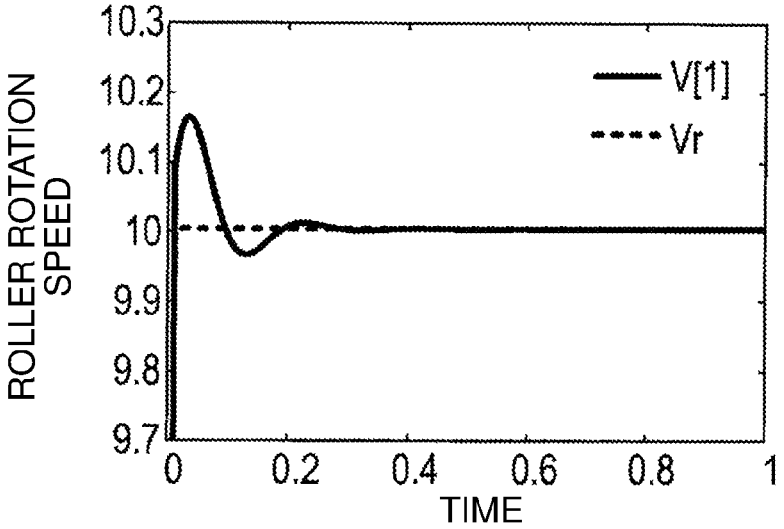
FIGS. 8A to 8C are graphs of rotating speeds of the rollers with respect to time.
Figure 8B:
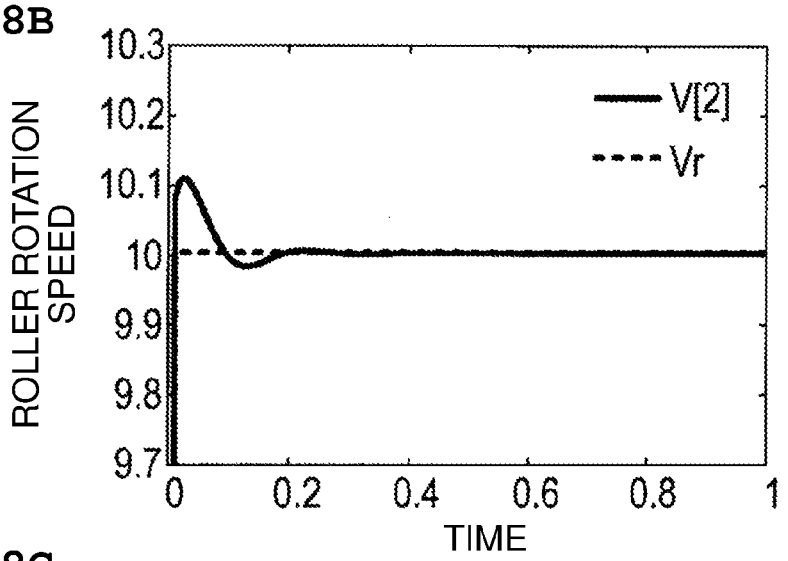
Figure 8C:
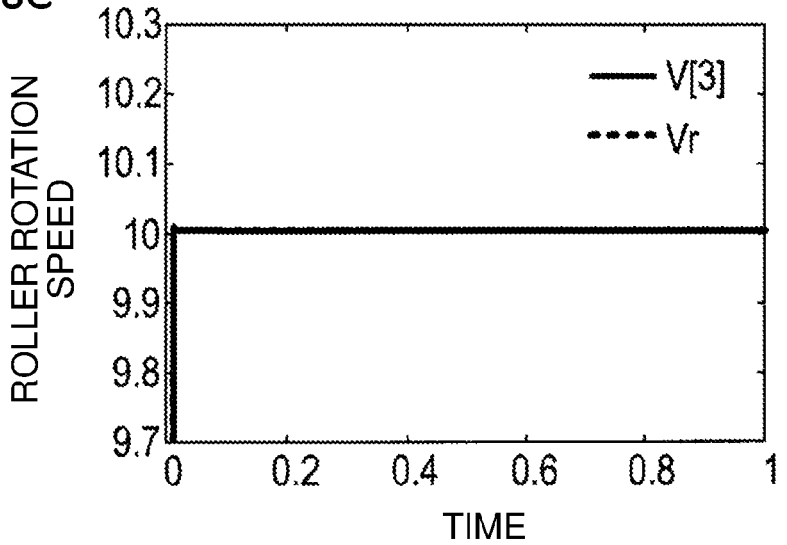

As understandable from FIG. 8C, the rotation speed V[3] of the third roller 230 indicated with the solid line in the graph is adjusted at once by the target speed Vr indicated with the broken line and, as understandable from FIGS. 8A and 8B, the rotation speeds V[1] and V[2] of the first roller 210 and the second roller 220 indicated with the solid lines in the graphs are adjusted later than the third roller 230, by the target speed Vr indicated with the broken lines. As a result of controlling the speed of the third roller 230 and the tension between the rollers, the first roller 210 and the second roller 220 rotate at the target speed Vr in operation, as with the third roller 230, such that the paper G may be conveyed at a constant speed corresponding to the target speed Vr.

According to the first embodiment, in the system of transporting the paper G by the rotations of the three rollers 210, 220 and 230, it is possible to appropriately control the tensions of the paper G between the rollers. In particular, by the appropriate tension control, it is possible to lessen the flexure of the paper G and prevent the paper G from slipping between the rollers 210, 220 and 230, so as to convey the paper G appropriately at constant speed.

Hence, according to the first embodiment, it is possible to restrain the landing points of the liquid droplets on the paper G from the deviation due to the flexure of the paper G, thereby enabling high quality images to be formed on the paper G. Especially, according to the first embodiment, because it is possible to control the tensions of the paper G by respectively setting the target values T12 and T23 for the tensions between the rollers, even if there is a difference in nip force between the respective rollers, it is still possible to prevent the slip from happening so as to realize a preferable transport control.

To add to the above description, the state control input computation section 350 may also be configured to calculate a deviation (Xr−X[3]) between a target position Xr and the rotation amount X[3] of the third roller 230, but not the deviation (Vr−V[3]) between the target speed Vr and the rotation speed V[3] of the third roller 230. In this case, it is possible to determine the target position Xr by a time integration of the target speed Vr. It is also possible to calculate the same state control input Uz by adopting either the deviation (Vr−V[3]) or the deviation (Xr−X[3]) as the deviation Ez.

Besides, in the first embodiment, correction is made with respect to the control inputs Uc[1], Uc[2] and Uc[3] on the respective motors, determined by the conversion section 360 based on the estimated disturbance value τ. However, the control inputs Uc[1], Uc[2] and Uc[3] may be input to the PWM signal generators 373, 383 and 393 without being corrected by the estimated disturbance value τ.

Further, it is possible for the main controller 10 to prevent the landing position from deviation by determining the timing of jetting the liquid droplets from the processing heads 51 and 53 according to the speed of the paper G. Therefore, the main controller 10 may preferably use, as the speed of the paper G, the information of the rotation speed V[3] of the third roller 230 predetermined as the roller of the speed control object, to determine the timing of jetting the liquid droplets from the processing heads 51 and 53.

Further, it is also possible to apply the technical idea according to the first embodiment to systems of transporting the paper G with two rotating rollers, and systems of transporting the paper G with four or more rotating rollers. Although the third roller 230 is set as the roller of the speed control object, it is possible to set any roller as the roller of the speed control object. It is conceivable to select the most upstream roller in the paper conveyance path or a roller with a high nip force, as the roller of the speed control object.

Suppose that the above technical idea is generalized in systems of transporting the paper G with two or any more numbers of rotating rollers. Hereinbelow, M will denote the number of rollers. In this case, it is possible to calculate the estimated tension value T[i] by the difference value T[i]=R[i]−R[i+1] of the estimated reaction force values of two rollers corresponding to each pair of adjacent rollers. i denotes an integer satisfying $1 \le i \le M-1$. T[i] denotes the estimated tension value for the pair of the ith roller and the (i+1)th roller among the M rollers. R[i] denotes the estimated reaction force value of the ith roller, while R[i+1] denotes the estimated reaction force value of the (i+1)th roller.

It is possible for the conveyance controller 100 to include a ith tension control input computation section ($1 \le i \le M-1$) to calculate the ith tension control input U[i], based on the deviation E[i]=Tr[i]−T[i] between the target tension Tr[i] and the estimated tension value T[i]=R[i]−R[i+1]. The M−1 tension control input computation sections, from the first tension control input computation section to the (M−1)th tension control input computation section, correspond to the roller number M, and take the place of the aforementioned first tension control input computation section 320 and second tension control input computation section 330.

It is possible for the conveyance controller 100 to include a state control input computation section, instead of the state control input computation section 350, to calculate the state control input Uz based on a deviation Ez=Zr−Z[k] between a target state quantity Zr and a state quantity Z[k] of the kth roller (measured value), when the kth roller (k is any integral value from 1 to M) is set as the roller of the speed control object.

The state quantity Z[k] may be either the rotation amount X[k] or the rotation speed V[k] of the kth roller. If the state quantity Z[k] is the rotation amount X[k], then the target state quantity Zr at each time is a time integration of the target speed Vr. If the state quantity Z[k] is the rotation speed V[k], then the target state quantity Zr is a time integration of the target speed Vr.

It is possible for the conversion section 360 to calculate the control input Uc[j] ($1 \le j \le M$) on each of the M motors, following the next relational expression, and based on the tension control input U[i] ($1 \le i \le M-1$) calculated by the first tension control input computation section to the (M−1)th tension control input computation section, and the state control input Uz calculated by the state control input computation section.

$$\begin{bmatrix} Uc[1] \\ Uc[2] \\ \vdots \\ Uc[M-1] \\ Uc[M] \end{bmatrix} = Q^{-1} \cdot \begin{bmatrix} U[1] \\ U[2] \\ \vdots \\ U[M-1] \\ Uz \end{bmatrix} \quad \text{[Formula 6]}$$

In the above formula, the matrix $Q^{-1}$ is the inverse of the following matrix Q.

$$Q = A + B \quad \text{[Formula 7]}$$

$$A = \begin{bmatrix} 1 & -1 & 0 & \dots & \dots & \dots & 0 \\ 0 & 1 & -1 & \ddots & & & \vdots \\ \vdots & \ddots & \ddots & \ddots & \ddots & & \vdots \\ \vdots & & \ddots & \ddots & \ddots & \ddots & \vdots \\ \vdots & & & \ddots & \ddots & \ddots & 0 \\ 0 & \dots & \dots & \dots & 0 & 1 & -1 \\ 0 & \dots & 0 & 0 & 0 & \dots & 0 \end{bmatrix},$$

$$B = \begin{bmatrix} 0 & \dots & \dots & \dots & \dots & \dots & 0 \\ \vdots & & & & & & \vdots \\ \vdots & & & & & & \vdots \\ \vdots & & & & & & \vdots \\ 0 & \dots & \dots & \dots & \dots & \dots & 0 \\ 0 & \dots & 0 & 0 & 0 & \dots & 0 \\ 0 & \dots & 0 & 1 & 0 & \dots & 0 \end{bmatrix}$$

The matrix Q, the matrix A and the matrix B presented above are matrixes of M lines and M columns corresponding to the number M of rollers, where in the matrix Q, the element of the mth line and the mth column has the value of 1, the element of the mth line and the (m+1)th column has the value of −1, the element of the Mth line and the kth column has the value 1, and the other elements have the value of 0, in the range of m<M, when the roller of the speed control object is the kth roller.

By the following formula, it is possible to represent the estimated tension value T[i] ($1 \le i \le M-1$) and the state quantity Z[k], using the matrixes A and B, and the estimated reaction force value R[j] and state quantity Z[j] of the jth roller ($1 \le j \le M$).

$$\begin{bmatrix} T[1] \\ T[2] \\ \vdots \\ T[M-1] \\ Z[k] \end{bmatrix} = A \cdot \begin{bmatrix} R[1] \\ R[2] \\ \vdots \\ R[M-1] \\ R[M] \end{bmatrix} + B \cdot \begin{bmatrix} Z[1] \\ Z[2] \\ \vdots \\ Z[M-1] \\ Z[M] \end{bmatrix} \quad \text{[Formula 8]}$$

Therefore, based on inverse matrix $Q^{-1}$ of the matrix Q=A+B, it is possible to convert the tension control input U[i] ($1 \le i \le M-1$) and the state control input Uz into the control input Uc[j] ($1 \le j \le M$) on each of the motors. It is possible for the conveyance controller 100 to include M motor controllers, from the first motor controller to the Mth motor controller, instead of the first motor controller 370, the second motor controller 380, and the third motor controller 390, to correspond to the M rollers.

That is, in a system with the M rollers, it is possible for the conveyance controller 100 to have M−1 tension control input computation sections, from the first tension control input computation section to the (M−1)th tension control input computation section, which have the same configuration as the tension control input computation sections 320 and 330 shown in FIG. 3. Further, it is possible to have one state control input computation section which has the same configuration as the state control input computation section 350 shown in FIG. 3. Further, following the above relational expression, it is possible to have a conversion section calculating the control input Uc[j] ($1 \le j \le M$) on each motor, and the M motor controllers, from the first motor controller to the Mth motor controller, which correspond respectively to the motors and have the same configuration as the motor controllers 370, 380 and 390 shown in FIG. 3. Further, it is possible for the conveyance controller 100 to have a target tension setting section to set the corresponding target tension Tr[i] ($1 \le i \le M-1$) for each of the tension control input computation sections from the first tension control input computation section to the (M−1)th tension control input computation section, and to have a target state quantity setting section to set the target speed Vr or the target position Xr for the state control input computation section.

With the conveyance system which determines the control input Uc[j] ($1 \le j \le M$) on each of the plurality of motors following the above relational expression, inputs, to the corresponding motor (the jth motor), the PWM signal based on control input Uc[j] (or the corrected control input Uc*[j] to which the estimated disturbance value $\tau$ is added), and controls the operation of transporting the paper G with the plurality of rotating rollers, it is possible to appropriately control the paper tension as well as the conveyance speed of the paper G.

Second Embodiment

Next, in order to facilitate understanding the above generalized technical idea, an image formation system 2 according to a second embodiment will be explained. The image formation system 2 of the second embodiment is configured to add a fourth roller 240 to the image formation system 1 of the first embodiment, and to add or change related constructions. Hereinbelow, explanations will be omitted for the same configurations as in the first embodiment.

Figure 9:
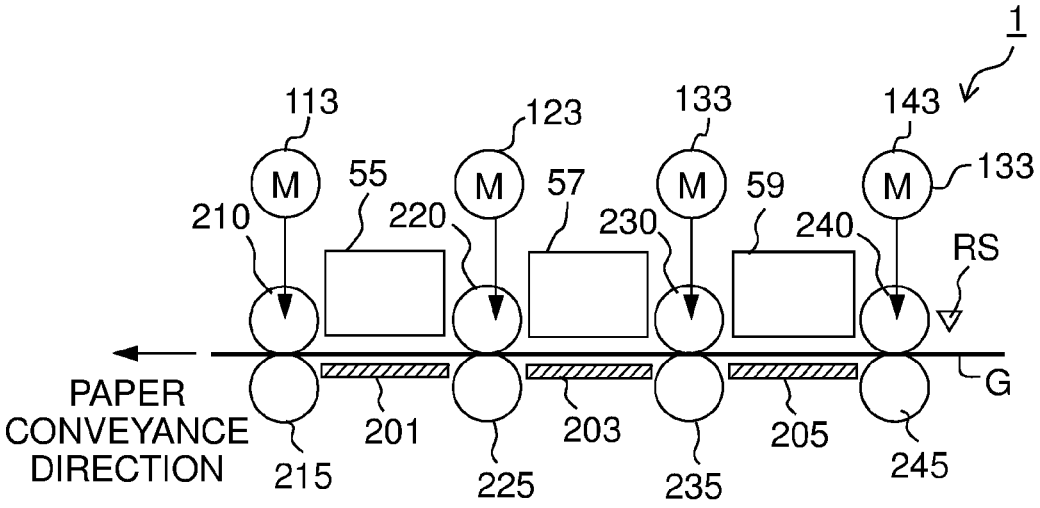
FIG. 9 is a diagram showing a configuration of a periphery of a paper conveyance path in an image formation system according to a second embodiment of the present invention.

As depicted in FIG. 9, the image formation system 2 of the second embodiment includes the conveyance mechanism 200 in which the first roller 210, the second roller 220, the third roller 230 and the fourth roller 240 are arranged apart from each other in the present order along the paper conveyance path, from downstream toward upstream of the paper conveyance path.

As in the first embodiment, the conveyance mechanism 200 includes the first driven roller 215, the second driven roller 225, the third driven roller 235 and, in addition, a fourth driven roller 245 arranged to face the fourth roller 240.

The fourth roller 240 conveys the paper G, supplied from the paper feeding unit 70, downstream toward the nip position at the third roller 230 by rotating while nipping the paper G between itself and the fourth driven roller 245. The fourth roller 240 is driven to rotate by a fourth motor 143 constructed of a DC motor similar to the first motor 113.

The paper conveyance path includes the platens 201, 203 and 205 as constituent elements to constitute the conveyance path for the paper G by supporting the paper G from below. A processing head 55 is arranged above the platen 201, and a processing head 57 is arranged above the platen 203. The platen 205 is arranged between the third roller 230 and the fourth roller 240. A processing head 59 is arranged above the platen 205.

The plurality of processing heads 55, 57 and 59 are arranged along the paper conveyance path between the rollers to jet liquid droplets of mutually different types. According to one example, the image formation system 2 is configured to include the processing heads 55 and 57 to jet ink droplets of mutually different colors onto the paper G, and the processing head 59 to jet, to the paper G, a transparent pretreatment liquid for improving the retention quality of the inks. A registration sensor RS is arranged in the upstream vicinity of the fourth roller 240.

Figure 10:
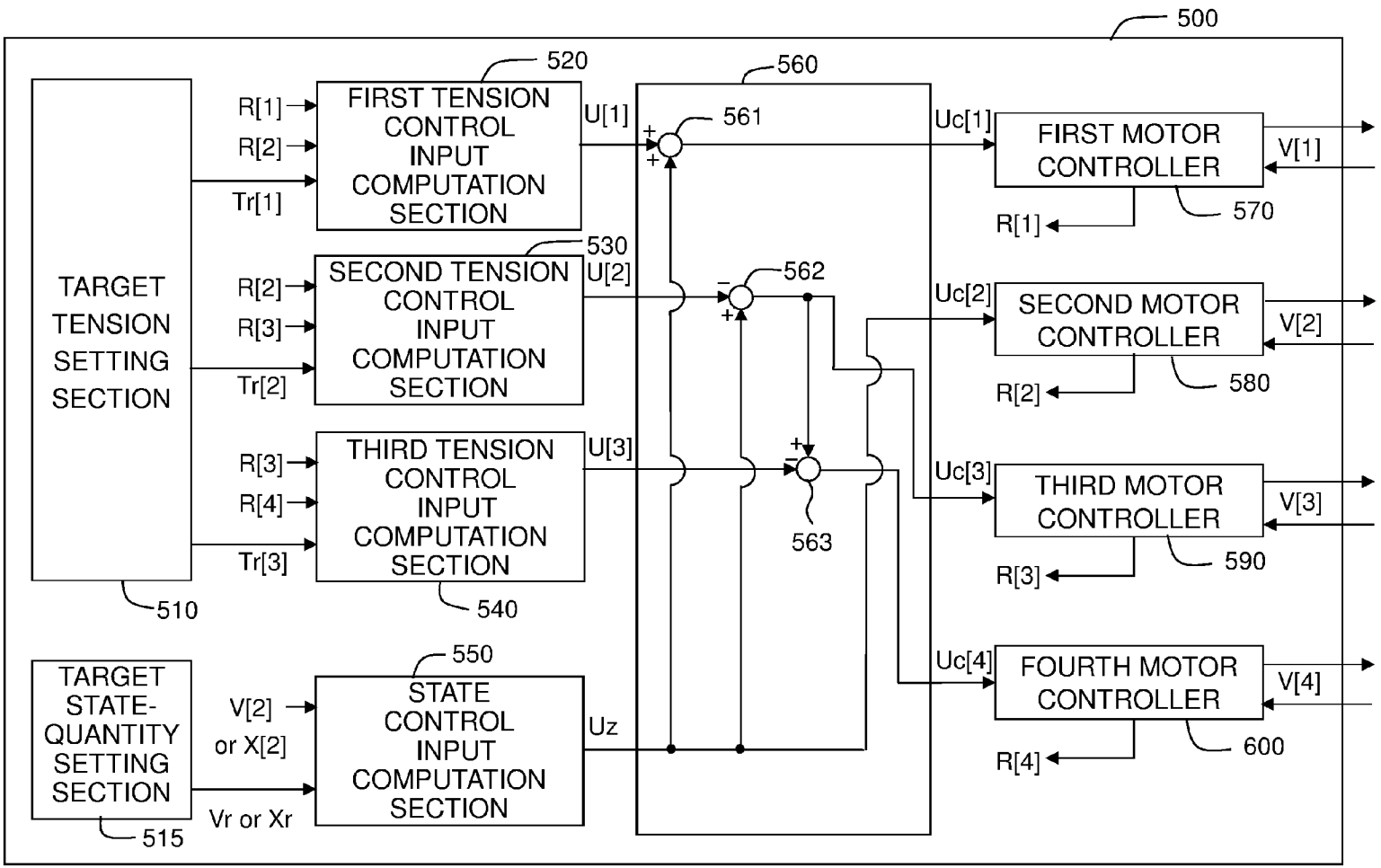
FIG. 10 is a block diagram showing a configuration of a conveyance controller according to the second embodiment.

Together with the inclusion of the fourth roller 240, the paper conveyance unit 90 is configured to further include a fourth control element group (not depicted), equivalent to the first control element group 110, for the fourth roller 240. Besides, the paper conveyance unit 90 is configured to include a conveyance controller 500 shown in FIG. 10, instead of the conveyance controller 100 of the first embodiment.

The conveyance controller 500 includes a target tension setting section 510, a target state quantity setting section 515, a first tension control input computation section 520, a second tension control input computation section 530, a third tension control input computation section 540, a state control input computation section 550, a conversion section 560, a first motor controller 570, a second motor controller 580, a third motor controller 590, and a fourth motor controller 600.

The target tension setting section 510 sets the first tension control input computation section 520 with the target tension Tr[1] for the paper tension exerted on the first roller 210 and the second roller 220, sets the second tension control input computation section 330 with the target tension Tr[2] for the paper tension exerted on the second roller 220 and the third roller 230, and sets the third tension control input computation section 340 with a target tension Tr[3] for the paper tension exerted on the third roller 230 and the fourth roller 240. The target state quantity setting section 515 sets the state control input computation section 550 with the target speed Vr corresponding to the conveyance speed for the paper G.

The first tension control input computation section 520 is configured in the same manner as the first tension control input computation section 320 of the first embodiment, to calculate the estimated tension value T[1]=R[1]−R[2] based on the estimated reaction force value R[1] of the first roller 210 and the estimated reaction force value R[2] of the second roller 220. Further, it calculates the tension control input U[1] corresponding to the deviation E[1]=Tr[1]−T[1] between the target tension Tr[1] and the estimated tension value T[1]. The calculated tension control input U[1] is input to the conversion section 560.

The second tension control input computation section 530 is configured in the same manner as the second tension control input computation section 330 of the first embodiment, to calculate the estimated tension value T[2]=R[2]−R[3] based on the estimated reaction force value R[2] of the second roller 220 and the estimated reaction force value R[3] of the third roller 230. Further, it calculates the tension control input U[2] corresponding to the deviation E[2]=Tr[2]−T[2] between the target tension Tr[2] and the estimated tension value T[2]. The calculated tension control input U[2] is input to the conversion section 560.

The third tension control input computation section 540 calculates an estimated tension value T[3]=R[3]−R[4] based on the estimated reaction force value R[3] of the third roller 230 and an estimated reaction force value R[4] of the fourth roller 240. Further, it calculates the tension control input U[3] corresponding to the deviation E[3]=Tr[3]−T[3] between the target tension Tr[3] and the estimated tension value T[3]. The calculated tension control input U[3] is input to the conversion section 560.

The state control input computation section 550 is configured in the same manner as the state control input computation section 350 of the first embodiment, to calculate the deviation Ez=Vr−V[2] between the target speed Vr and the rotation speed V[2] (measured value) of the second roller 220 predetermined as a speed control object roller in the second embodiment, and to calculate the state control input Uz corresponding to the deviation Ez. The calculated state control input Uz is input to the conversion section 560.

The conversion section 560 calculates the control inputs Uc[1], Uc[2], Uc[3] and Uc[4] on the motors, respectively, based on the tension control input U[1], U[2] and U[3] obtained form the tension control input computation sections 520, 530 and 540, and the state control input Uz obtained from the state control input computation section 550. The control input Uc[1] is the control input on the first motor 113, the control input Uc[2] is the control input on the second motor 123, the control input Uc[3] is the control input on the third motor 133, and the control input Uc[4] is a control input on the fourth motor 143.

The conversion section 560 includes a first computation section 561, a second computation section 562, and a third computation section 563. The first computation section 561 calculates the control input Uc[1] on the first motor 113, following the relational expression Uc[1]=U[1]+Uz. The second computation section 562 calculates the control input Uc[3] on the third motor 133, following the relational expression Uc[3]=−U[2]+Uz. The third computation section 563 calculates the control input Uc[4] on the fourth motor 143, following the relational expression Uc[4]=−U[2]−U[3]+Uz.

The conversion section 560 inputs the control input Uc[1] calculated in the above manner to the first motor controller 570, inputs the control input Uc[3] to the third motor controller 590, and inputs the control input Uc[4] to the fourth motor controller 600. Further, the conversion section 560 inputs the state control input Uz as the control input Uc[2] for the second motor controller 580, to the second motor controller 580.

The first motor controller 570 inputs the PWM signal corresponding to the control input Uc[1] to the first motor 113 and, on the other hand, calculates the estimated reaction force value R[1] based on the control input Uc[1] and the rotation speed V[1] (measured value) of the first roller 210.

The second motor controller 580 inputs the PWM signal corresponding to the control input Uc[2] to the second motor 123 and, on the other hand, calculates the estimated reaction force value R[2] based on the control input Uc[2] and the rotation speed V[2] (measured value) of the second roller 220.

The third motor controller 590 inputs the PWM signal corresponding to the control input Uc[3] to the third motor 133 and, on the other hand, calculates the estimated reaction force value R[3] based on the control input Uc[3] and the rotation speed V[3] (measured value) of the third roller 230.

The fourth motor controller 600 inputs the PWM signal corresponding to the control input Uc[4] to the fourth motor 143 and, on the other hand, calculates the estimated reaction force value R[4] based on the control input Uc[4] and the rotation speed V[4] (measured value) of the fourth roller 240.

In the second embodiment, based on the following principle, the conversion section 560 carries out the conversion from the tension control inputs U[1], U[2] and U[3] and the state control input Uz to the control inputs Uc[1], Uc[2], Uc[3] and Uc[4] on the respective motors.

It is possible to represent, by the following formula, the estimated tension value T[i] ($1 \le i \le 3$) and the rotation speed V[3] of the second roller 220, using the estimated reaction force value R[j] and rotation speed V[j] of the jth roller ($1 \le j \le 4$).

$$\begin{bmatrix} T[1] \\ T[2] \\ T[3] \\ V[2] \end{bmatrix} = A \cdot \begin{bmatrix} \begin{bmatrix} R[1] \\ R[2] \\ R[3] \\ R[4] \end{bmatrix} \end{bmatrix} + B \cdot \begin{bmatrix} \begin{bmatrix} V[1] \\ V[2] \\ V[3] \\ V[4] \end{bmatrix} \end{bmatrix} \quad \text{[Formula 9]}$$

$$A = \begin{bmatrix} 1 & -1 & 0 & 0 \\ 0 & 1 & -1 & 0 \\ 0 & 0 & 1 & -1 \\ 0 & 0 & 0 & 0 \end{bmatrix}, B = \begin{bmatrix} 0 & 0 & 0 & 0 \\ 0 & 0 & 0 & 0 \\ 0 & 0 & 0 & 0 \\ 0 & 1 & 0 & 0 \end{bmatrix}$$

Hence, it is possible to represent, by the following formula, a relationship between the tension control inputs U[1], U[2] and U[3] with the state control input Uz, and the control inputs Uc[1], Uc[2], Uc[3] and Uc[4] on the respective motors, using the inverse matrix $(A+B)^{-1}$ of the matrix (A+B).

$$\begin{bmatrix} Uc[1] \\ Uc[2] \\ Uc[3] \\ Uc[4] \end{bmatrix} = (A+B)^{-1} \cdot \begin{bmatrix} U[1] \\ U[2] \\ U[3] \\ Uz \end{bmatrix} \quad \text{[Formula 10]}$$

$$(A+B)^{-1} = \begin{bmatrix} 1 & 0 & 0 & 1 \\ 0 & 0 & 0 & 1 \\ 0 & -1 & 0 & 1 \\ 0 & -1 & -1 & 1 \end{bmatrix}$$

For such reasons, in the conversion section 560 as described above, the control inputs Uc[1], Uc[2], Uc[3] and Uc[4] on the respective motors are calculated from the tension control inputs U[1], U[2] and U[3], and the state control input Uz.

Therefore, according to the second embodiment, it is also possible to obtain the same effects as the first embodiment, thereby enabling an appropriate control of the paper tensions between the rollers and the speed of transporting the paper G. Hence, it is possible to restrain the landing points of the liquid droplets on the paper G from the deviation due to flexure of the paper G, thereby enabling formation of high quality image on the paper G.

Third Embodiment

Figure 11:
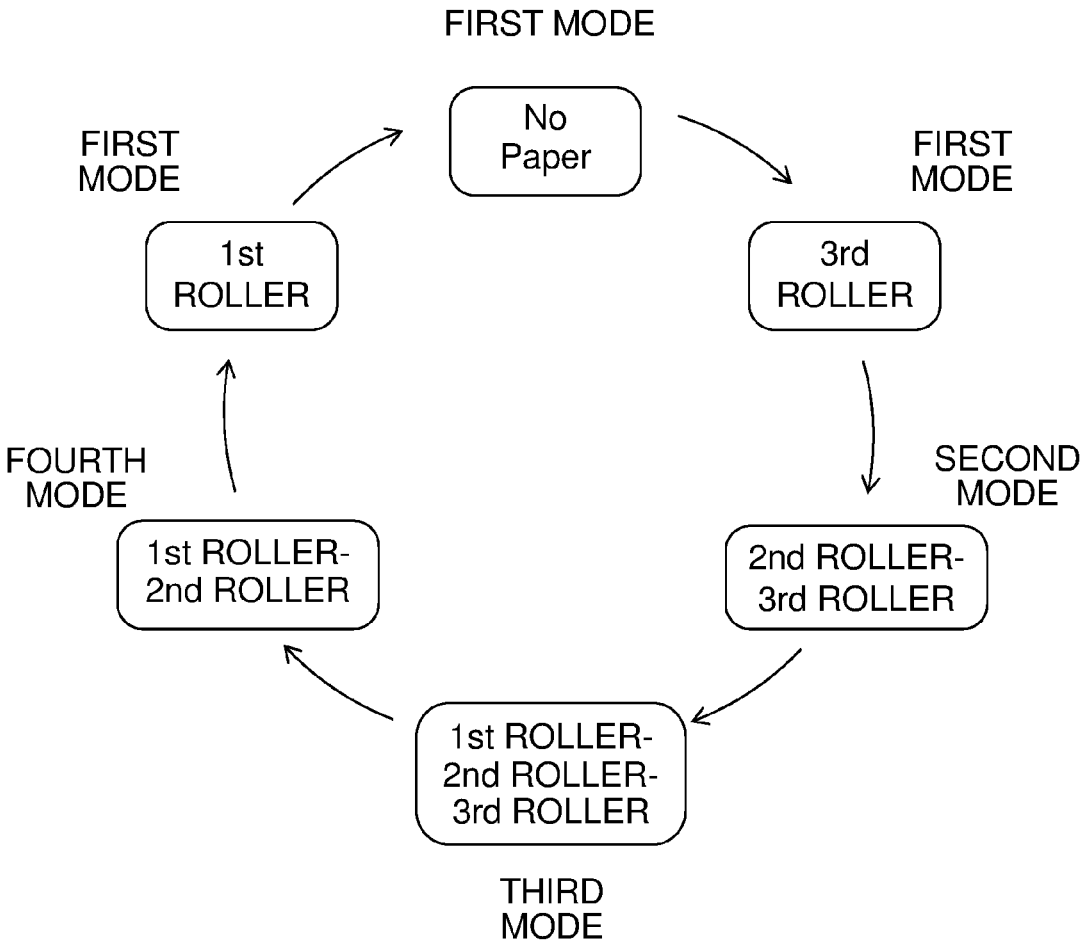
FIG. 11 is an explanatory diagram for explanation of switching a control mode based on a positional relation between paper and the rollers.

Next, an image formation system 1A according to a third embodiment will be explained. The image formation system 1A of the third embodiment has almost the same configuration as the image formation system 1 of the first embodiment. Hereinbelow, the same reference numerals or alphanumerals will be assigned to the components of the same configuration as those in the first embodiment, and any explanation therefor will be omitted as appropriate. Further, in the first embodiment as depicted in FIG. 1, the motors driving the respective rollers are controlled to appropriately adjust the paper tension between the rollers with the paper G being in contact with all of the first roller 210, the second roller 220 and the third roller 230. In the third embodiment, in contrast, as depicted in FIG. 11, a plurality of control modes are switched according to the position at which the paper G is located with respect to the first roller 210, the second roller 220, and the third roller 230.

Figure 16:
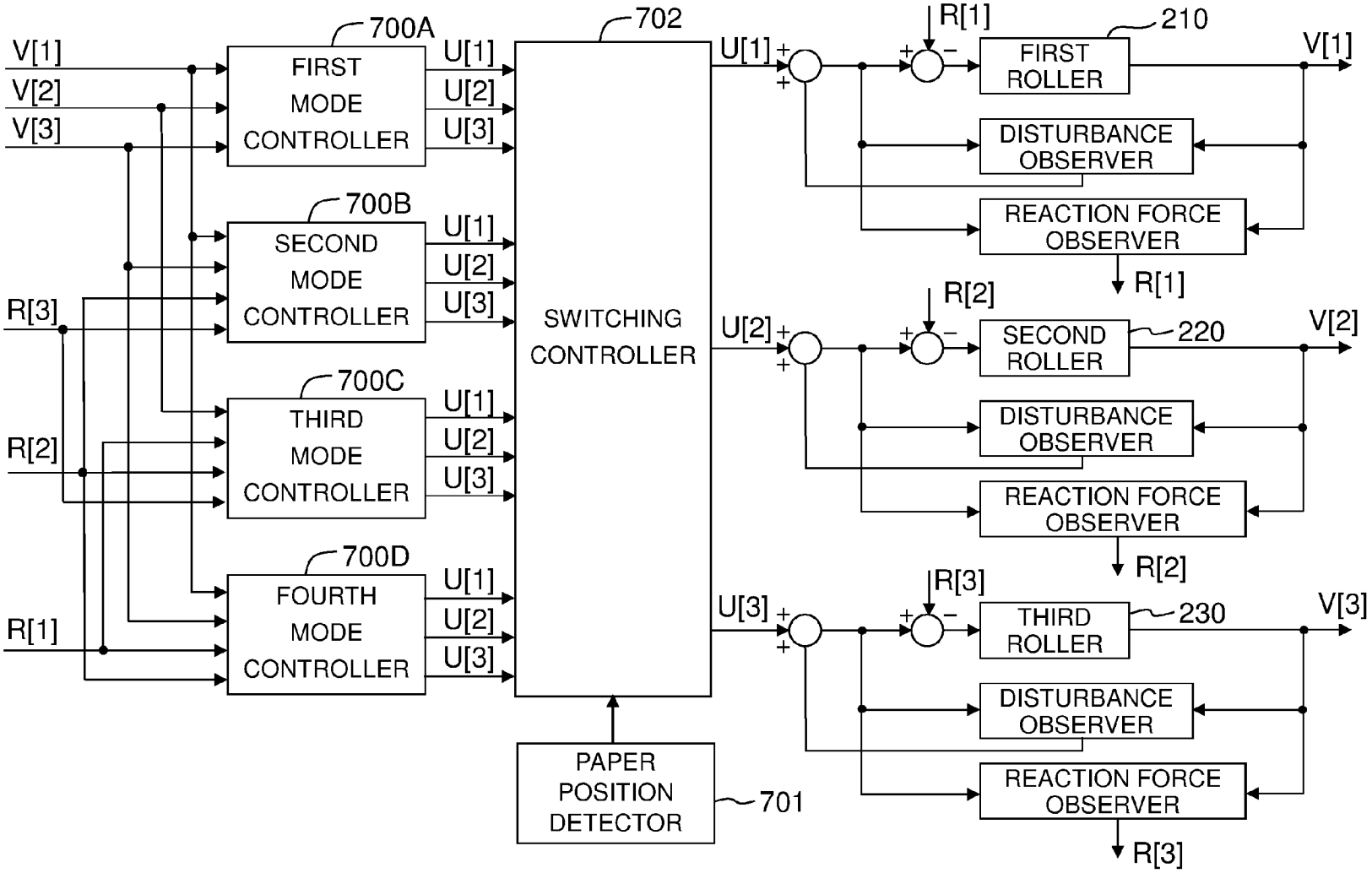
FIG. 16 is a block diagram showing a configuration of a conveyance controller according to a third embodiment.

Further, in the following manner, it is possible to perceive the position at which the paper G is located. As depicted in FIG. 1, because the registration sensor RS is placed on the upstream side from the third roller 230, it is possible to detect the time (to be referred to as the time T0) when the anterior end of the paper G is past the registration sensor RS. As depicted in FIG. 16, a conveyance controller 100A of the third embodiment includes a paper position calculation section 701 and a control mode switching device 702. The paper position calculation section 701 calculates the position at which the anterior end of the paper G is located, based on the elapsed time from the time T0, provided that the paper G is conveyed at constant speed. Further, when the main controller 10 obtains the image data, the main controller 10 also obtains information regarding a size of the paper G. Therefore, the paper position calculation section 701 can calculate a position at which a rear end of the paper G is located, based on the information regarding the size of the paper G and the calculated position at which the anterior end the paper G is located. Then, the control mode switching device 702 switches aftermentioned first to fourth control mode setting sections according to the position of the anterior end of the paper G calculated by the paper position calculation section 701.

Before the paper G arrives at the third roller 230, the first roller 210, the second roller 220, and the third roller 230 are all set as the speed control object rollers. On this occasion, because no roller is in contact with the paper G, it is possible to set the target speeds arbitrarily. In the third embodiment, the first motor 113, the second motor 123, and the third motor 133 are controlled in terms of speed (as in a first control mode) such that the rotation speeds V[1], V[2], and V[3] may respectively become target speeds V1, V2, and V3. The target speed V1 corresponds to the rotation speed of the first roller 210 when the paper G is conveyed with the first roller 210 at a predetermined conveyance speed. Likewise, the target speed V2 corresponds to the rotation speed of the second roller 220 when the paper G is conveyed with the second roller 220 at the predetermined conveyance speed, and the target speed V3 corresponds to the rotation speed of the third roller 230 when the paper G is conveyed with the third roller 230 at the predetermined conveyance speed.

Figure 12:
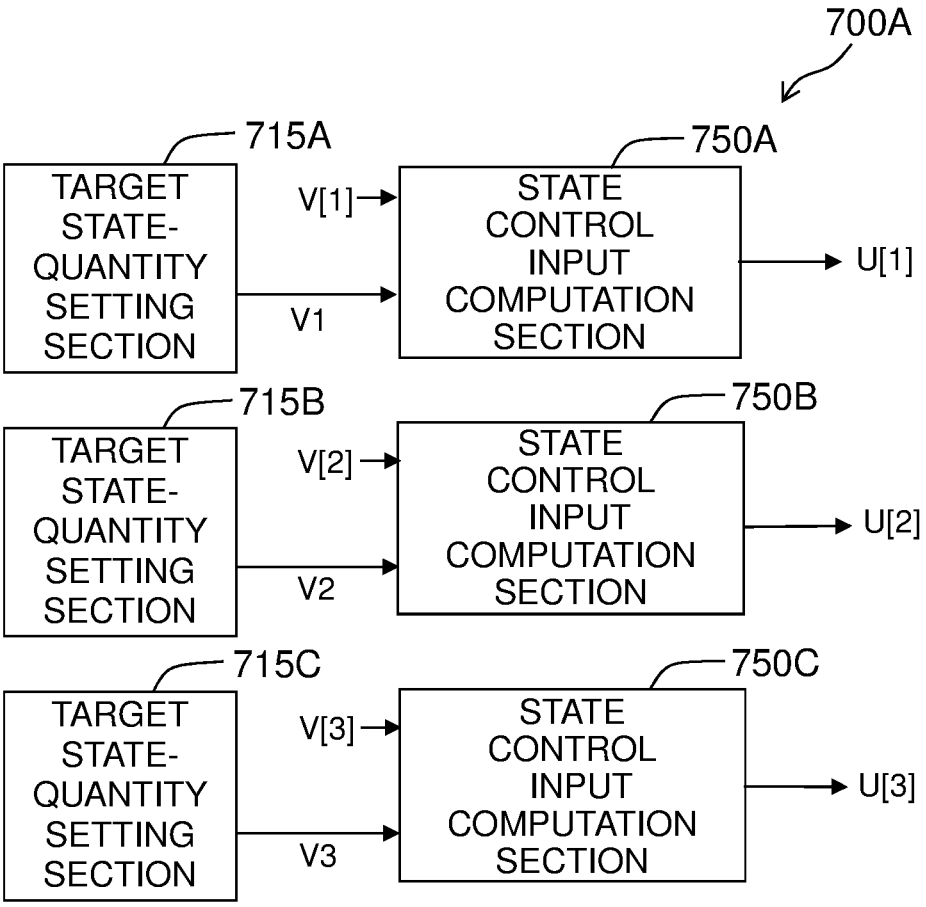
FIG. 12 is a schematic diagram of a first control mode setting section 700A.

In particular as depicted in FIG. 12, the conveyance controller 100A includes the first control mode setting section 700A having three target state quantity setting sections 715A, 715B and 715C, and three state control input computation sections 750A, 750B and 750C. Before the paper G arrives at the third roller 230, the control mode switching device 702 selects the first control mode setting section 700A (see FIG. 16). A control input U[1] on the first motor 113 is calculated by the target state quantity setting section 715A and the state control input computation section 750A. A control input U[2] on the second motor 123 is calculated by the target state quantity setting section 715B and the state control input computation section 750B. Further, a control input U[3] on the third motor 133 is calculated by the target state quantity setting section 715C and the state control input computation section 750C. By virtue of this, the first motor 113, the second motor 123, and the third motor 133 are controlled such that the rotation speeds V[1], V[2] and V[3] of the first roller 210, the second roller 220 and the third roller 230 may respectively become the target speeds V1, V2 and V3.

Next, when the anterior end of the paper G arrives at the third roller 230, then the third roller 230 is set as a speed control object roller, and the third roller 230 is controlled such that the rotation speed V[3] may become the target speed V3. The first roller 210 and the second roller 220 are also set as speed control object rollers. Further, because the first roller 210 and the second roller 220 are not in contact with the paper G, it is possible to set the target speeds arbitrarily. In the third embodiment, however, in the same manner as before the paper G arrives at the third roller 230, the first motor 113, the second motor 123, and the third motor 133 are controlled in terms of speed (in the first control mode) such that the rotation speeds V[1], V[2] and V[3] of the first roller 210, the second roller 220 and the third roller 230 may respectively become the target speeds V1, V2 and V3. By virtue of this, before and after the anterior end of the paper G arrives at the third roller 230, it is possible to maintain the first control mode without needing to change the control mode.

Next, when the anterior end of the paper G arrives at the second roller 220 and when the paper G is in contact with the second roller 220 and the third roller 230, then the third roller 230 is set as the speed control object roller, and the third roller 230 is controlled such that the rotation speed V[3] may become the target speed V3. At the same time, the second motor 123 driving the second roller 220 is controlled to appropriately maintain the tension between the third roller 230 and the second roller 220. Further, the first motor 113 is controlled in terms of speed (as in a second control mode) such that the rotation speed V[1] of the first roller 210 may become the target speed V1.

Figure 13:
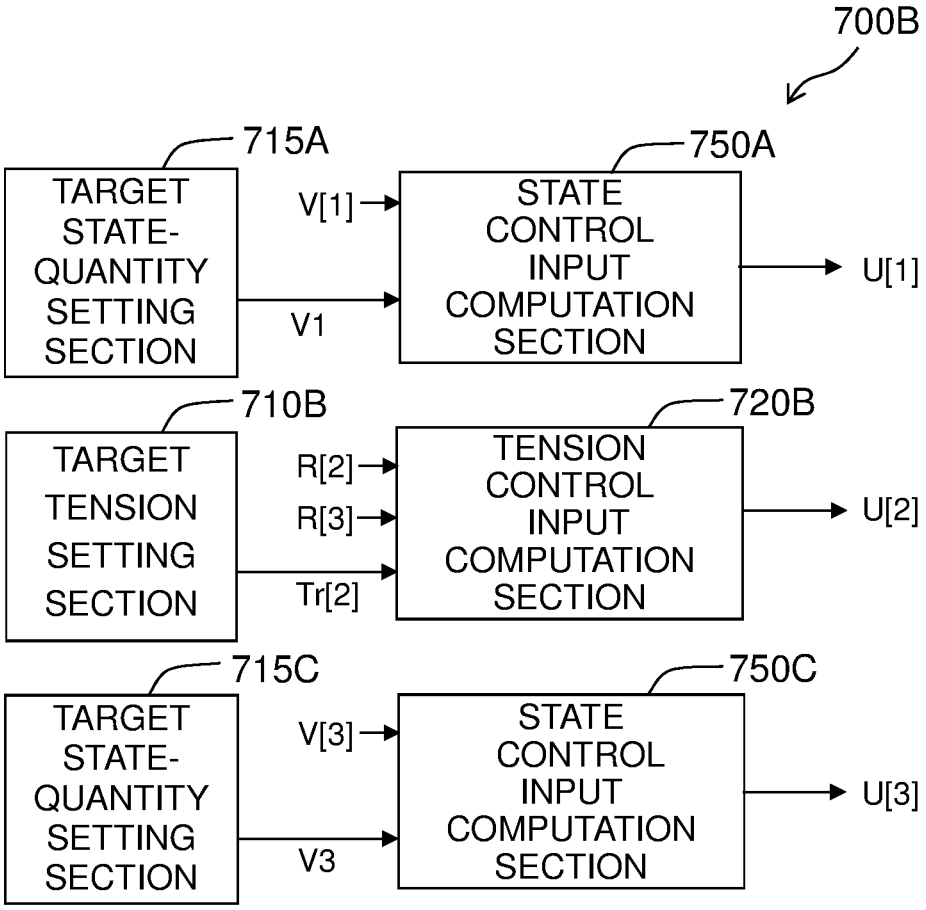
FIG. 13 is a schematic diagram of a second control mode setting section 700B.

In order to realize the above control, as depicted in FIG. 13, the conveyance controller 100A of the third embodiment includes the second control mode setting section 700B having two target state quantity setting sections 715A and 715C, two state control input computation sections 750A and 750C, one target tension setting section 710B, and one tension control input computation section 720B. Thus, when the anterior end of the paper G arrives at the second roller 220, the control mode switching device 702 deselects the first control mode setting section 700A, and selects the second control mode setting section 700B (see FIG. 16). The control input U[1] on the first motor 113 is calculated by the target state quantity setting section 715A and the state control input computation section 750A. The control input U[2] on the second motor 123 is calculated by the target tension setting section 710B and the tension control input computation section 720B. Further, the control input U[3] on the third motor 133 is calculated by the target state quantity setting section 715C and the state control input computation section 750C. By virtue of this, the first motor 113 and the third motor 133 are controlled such that the rotation speeds V[1] and V[3] of the first roller 210 and the third roller 230 may respectively become the target speeds V1 and V3. Further, the second motor 123 is controlled such that the tension between the second roller 220 and the third roller 230 may be appropriate.

Next, when the anterior end of the paper G arrives at the second roller 220 and when the paper G is in contact with the first roller 210, the second roller 220, and the third roller 230, then the second roller 220 is set as the speed control object roller, and the second roller 220 is controlled such that the rotation speed V[2] may become the target speed V2. At the same time, the third motor 133 driving the third roller 230 is controlled to appropriately maintain the tension between the third roller 230 and the second roller 220. Further, the first motor 113 driving the first roller 210 is controlled (as in a third control mode) to appropriately maintain the tension between the second roller 220 and the first roller 210.

Figure 14:
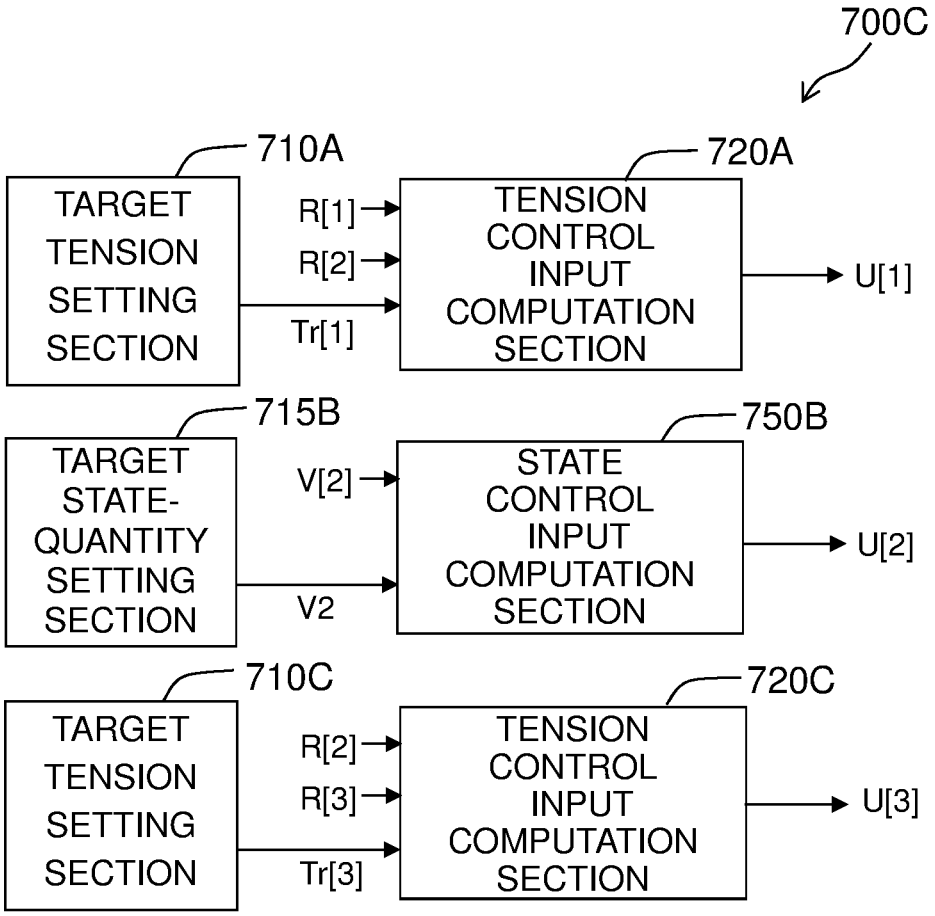
FIG. 14 is a schematic diagram of a third control mode setting section 700C.

In order to realize the above control, as depicted in FIG. 14, the conveyance controller 100A of the third embodiment includes the third control mode setting section 700C having one target state quantity setting section 715B, one state control input computation section 750B, two target tension setting sections 710A and 710C, and two tension control input computation sections 720A and 720C. Thus, when the anterior end of the paper G arrives at the first roller 210, the control mode switching device 702 deselects the second control mode setting section 700B, and selects the third control mode setting section 700C (see FIG. 16). The control input U[1] on the first motor 113 is calculated by the target tension setting section 710A and the tension control input computation section 720A. The control input U[2] on the second motor 123 is calculated by the target state quantity setting section 715B and the state control input computation section 750B. Further, the control input U[3] on the third motor 133 is calculated by the target tension setting section 710C and the tension control input computation section 720C. By virtue of this, the second motor 123 is controlled such that the rotation speed V[2] of the second roller 220 may become the target speed V2. Further, the first motor 113 is controlled such that the tension between the first roller 210 and the second roller 220 may be appropriate. Further, the third motor 133 is controlled such that the tension between the second roller 220 and the third roller 230 may be appropriate.

Next, when the posterior end of the paper G departs from the third roller 230 and when the paper G is in contact with the first roller 210 and the second roller 220, then the first roller 210 is set as a speed control object roller, and the first roller 210 is controlled such that the rotation speed V[1] may become the target speed V1. Further, the third roller 230 not in contact with the paper G is also set as a speed control object roller, and the third roller 230 is controlled such that the rotation speed V[3] may become the target speed V3. Further, the second motor 123 driving the second roller 220 is controlled (as in a fourth control mode) to appropriately maintain the tension between the first roller 210 and the second roller 220.

Figure 15:
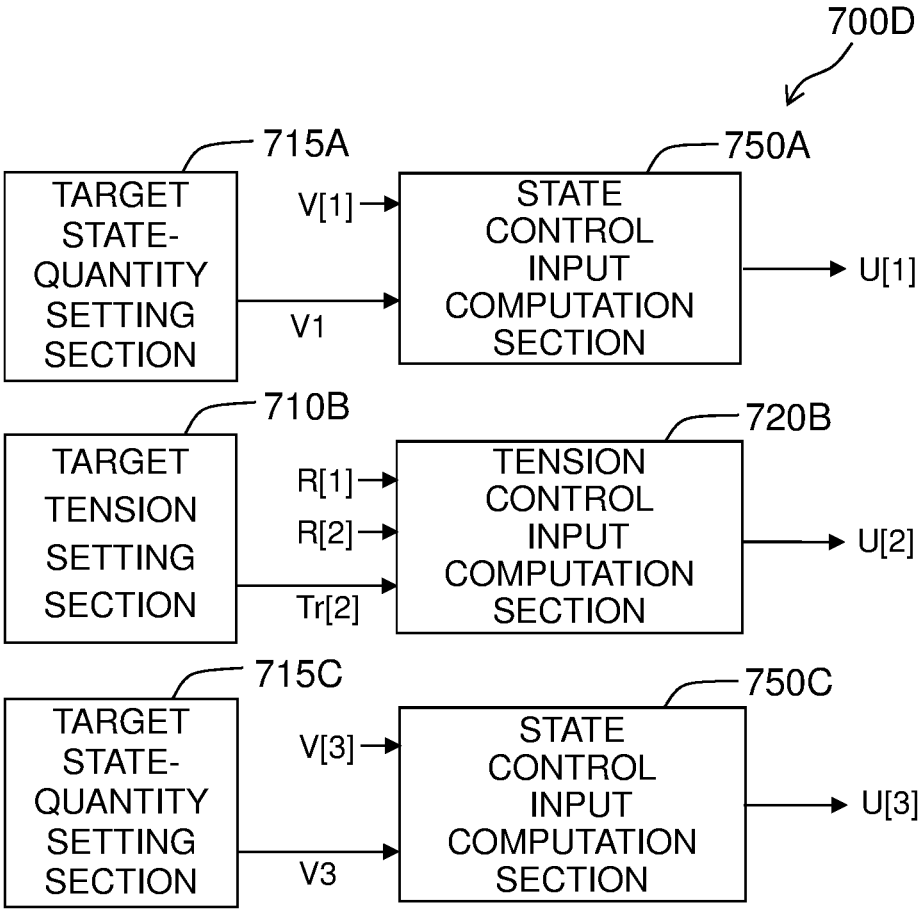
FIG. 15 is a schematic diagram of a fourth control mode setting section 700D.

In order to realize the above control, as depicted in FIG. 15, the conveyance controller 100A of the third embodiment includes the fourth control mode setting section 700D having two target state quantity setting sections 715A and 715C, two state control input computation sections 750A and 750C, one target tension setting section 710B, and one tension control input computation sections 720B. Thus, when the posterior end of the paper G departs from the third roller 230, the control mode switching device 702 deselects the third control mode setting section 700C, and selects the fourth control mode setting section 700D (see FIG. 16). The control input U[1] on the first motor 113 is calculated by the target state quantity setting section 715A and the state quantity control input computation section 750A. The control input U[2] on the second motor 123 is calculated by the target tension setting section 710B and the tension control input computation section 720B. Further, the control input U[3] on the third motor 133 is calculated by the target state quantity setting section 715C and the state control input computation section 750C. By virtue of this, the first motor 113 is controlled such that the rotation speed V[1] of the first roller 210 may become the target speed V1. Further, the second motor 123 is controlled such that the tension between the first roller 210 and the second roller 220 may be appropriate. Further, the third motor 133 is controlled such that the rotation speed V[3] of the third roller 230 may become the target speed V3.

Next, when the posterior end of the paper G departs from the second roller 220 and when the paper G is in contact with the first roller 210 only, then the first roller 210 is set as a speed control object roller, and the first roller 210 is controlled such that the rotation speed V[1] may become the target speed V1. Further, the second roller 220 and the third roller 230 not in contact with the paper G are also set as speed control object rollers, and the second roller 220 and the third roller 230 are controlled (in the first control mode) such that the rotation speeds V[2] and V[3] may respectively become the target speeds V2 and V3.

In order to realize the above control, in the conveyance controller 100A of the third embodiment, when the posterior end of the paper G departs from the second roller 220, the control mode switching device 702 deselects the fourth control mode setting section 700D, and selects the first control mode setting section 700A (see FIG. 16).

Further, the first control mode is still maintained even when the posterior end of the paper G departs from the first roller 210 such that the paper G is no longer in contact with any of the first roller 210, the second roller 220 and the third roller 230.

In the above manner, according to the third embodiment, the plurality of control modes are switched according to the position at which the paper G is located with respect to the first roller 210, the second roller 220, and the third roller 230. Then, before and after the paper G arrives at any of the rollers or departs from any of the rollers, the roller(s) reliably nipping the paper G is set to be a speed control object(s). By virtue of this, when the paper G arrives at or departs from any of the rollers, it is not only possible to diminish speed variance of the paper G but also possible to appropriately adjust the tension between the rollers in contact with the paper G.

While the image formation systems of the first, second and third embodiments were explained above, the present disclosure is not limited to the above embodiments but is able to adopt various other aspects.

For example, it is possible to apply the present disclosure to various other systems involving sheet conveyance than image formation systems. For example, it is possible to apply the present disclosure to image reading systems which convey sheets and read images formed on the sheets.

Besides, the conveyance controllers 100 and 500 may either be configured as dedicated circuits such as ASIC or be configured by microcomputers. For example, it is possible to realize, through software, each function fulfilled by the conveyance controllers 100 and 500 as described above, by providing the conveyance controllers 100 and 500 with the CPU 101 and the ROM 103 as depicted in FIG. 2 and letting the CPU 101 carry out a process subject to a program recorded in the ROM 103. With respect to each of the conveyance controllers 100 and 500, some functions may be realized through hardware while the other functions may be realized through software.

The function of one component in the above embodiments may be provided dispersively in a plurality of components. On the other hand, the function of a plurality of components may be integrated into one component. Part of the configuration of the above embodiments may be omitted. Embodiments of the present invention encompass each and every aspect included in the technical idea identified from the language of description of the appended claims.

There is a correspondence relationship between the words and terms as follows. The encoders 115, 125 and 135 and the signal processing circuits 117, 127 and 137 correspond to one example of the measuring devices. The conveyance controllers 100 and 500 correspond to the controller controlling the operation of transporting the sheets with the plurality of rotating rollers. The process realized by the conversion sections 360 and 560 corresponds to one example of the determination process, while the process realized by the PWM signal generators 373, 383 and 393 and the drive circuits 111, 121 and 131 corresponds to one example of the drive control process. Inputting the PWM signal according to the control inputs with respect to the drive circuits 111, 121 and 131, and applying the drive current according to the control inputs on the motors 113, 123 and 133 correspond to one example of inputting the drive signals corresponding to the control inputs.

Besides, the process realized by the reaction force observers 377, 387 and 397 corresponds to one example of the reaction force estimation process, while the process realized by the estimated tension value calculation sections 321 and 331 corresponds to one example of the tension estimation process. The process realized by the deviation calculation section 325 and the control input calculation section 329, and the process realized by the deviation calculation section 335 and the control input calculation section 339 correspond to one example of the first control input computation process, while the process realized by the deviation calculation section 355 and the control input calculation section 359 corresponds to one example of the second control input computation process. The processing heads 51, 53, 55, 57 and 59 correspond to one example of the processing devices.

What is claimed is:

1. A conveyance system comprising:

a plurality of rollers for conveying a sheet, the plurality of rollers being arranged apart from each other along a conveyance path for the sheet;

a plurality of motors provided to correspond respectively to the plurality of rollers, each of the plurality of motors being configured to rotationally drive the corresponding one roller among the plurality of rollers;

a plurality of measuring devices provided to correspond respectively to the plurality of rollers, each of the plurality of measuring devices being configured to measure a state quantity related to a rotating motion of the corresponding one roller among the plurality of rollers; and a controller configured to control, via the plurality of motors, an operation of conveying the sheet by rotation of the plurality of rollers, wherein the controller is configured to carry out processes of:

determining a control input on each of the plurality of motors;

inputting a drive signal according to the determined control input to each of the plurality of motors;

calculating, for each of the rollers, an estimated reaction force value which is an estimated value of a reaction force acting on the roller, based on the state quantity measured by the measuring device corresponding to the roller among the plurality of measuring devices, and the determined control input on the roller;

calculating, for each pair of adjacent rollers among the plurality of rollers, an estimated tension value which is an estimated value of sheet tension exerted on the pair, based on the estimated reaction force value for the pair;

calculating, for each pair, a tension control input which is a control input for controlling the sheet tension exerted on the pair under a target tension, based on a deviation between the target tension and the estimated tension value for the pair; and calculating a state control input which is a control input for controlling the state quantity of one particular roller under a target state quantity, among the plurality of rollers, based on the target state quantity and the state quantity measured by the measuring device corresponding to the particular roller among the plurality of measuring devices, wherein upon determining the control input on each of the plurality of motors, the controller determines the control input on each of the plurality of motors based on the calculated tension control input for each pair, and the calculated state control input on the particular roller.

2. The conveyance system according to claim 1, wherein upon estimating the tension value, the controller calculates, for each pair, the estimated tension value T[i] for the pair as a difference value T[i]=R[i]−R[i+1] between the estimated reaction force values for the adjacent rollers corresponding to the pair (where i is an integer satisfying 1≤i≤M−1, M is the number of the plurality of rollers, T[i] denotes the estimated tension value for the pair of the ith roller and the (i+1)th roller among the plurality of rollers, R[i] denotes the estimated reaction force value for the ith roller, and R[i+1] denotes the estimated reaction force value for the (i+1)th roller); and the controller determines the control input Uc[j] on each of the plurality of motors, following the next relational expression:

$$\begin{bmatrix} Uc[1] \\ Uc[2] \\ \vdots \\ Uc[M-1] \\ Uc[M] \end{bmatrix} = Q^{-1} \cdot \begin{bmatrix} U[1] \\ U[2] \\ \vdots \\ U[M-1] \\ Uz \end{bmatrix}. \quad \text{[Formula 1]}$$

based on the calculated tension control input U[i] for each pair, and the calculated state control input Uz (where U[i] denotes the tension control input for the pair of the ith roller and the (i+1)th roller, i is an integer satisfying 1≤i≤M−1, Uc[j] denotes the control input on the motor rotationally driving the jth roller among the plurality of motors, j is an integer satisfying 1≤j≤M, the matrix $Q^{-1}$ denotes the inverse of the matrix Q, the matrix Q is a matrix of M lines and M columns, and if the particular roller is the kth roller (where k is an integral value from 1 to M), then in the matrix Q, the element of the mth line and the mth column has the value of 1, the element of the mth line and the (m+1)th column has the value of −1, the element of the Mth line and the kth column has the value 1, and the other elements have the value of 0, in the range of m<M).

3. The conveyance system according to claim 1, wherein each of the measuring devices is configured to measure one of a rotation amount and a rotation speed of the corresponding one roller as the state quantity related to the rotating motion of that roller.

4. The conveyance system according to claim 1, wherein the plurality of rollers include a first roller, a second roller and a third roller in order from downstream toward upstream along the conveyance path for the sheet;

the plurality of motors include a first motor for rotationally driving the first roller, a second motor for rotationally driving the second roller, and a third motor for rotationally driving the third roller;

the particular roller is prescribed to be the third roller; and upon estimating the tension value, the controller calculates an estimated tension value T[1] for the adjacent pair of the first roller and the second roller following the relational expression T[1]=R[1]−R[2] and calculates an estimated tension value T[2] for the adjacent pair of the second roller and the third roller following the relational expression T[2]=R[2]−R[3], as the estimated tension value for each pair, based on the estimated reaction force value R[1] for the first roller, the estimated reaction force value R[2] for the second roller and the estimated reaction force value R[3] for the third roller which are all calculated, the controller calculates a tension control input U[1] based on the estimated tension value T[1] and a target tension Tr[1] corresponding to the pair of the first roller and the second roller, and a tension control input U[2] based on the estimated tension value T[2] and a target tension Tr[2] corresponding to the pair of the second roller and the third roller, as the tension control input for each pair, the controller calculates a state control input U[3], as the state control input, based on the target state quantity and the state quantity of the third roller measured by the measuring device corresponding to the third roller among the plurality of measuring devices, and the controller determines a control input Uc[1] on the first motor following the relational expression Uc[1]=U[1]+U[2]+U[3], determines a control input Uc[2] on the second motor following the relational expression Uc[2]=U[2]+U[3], and determines a control input Uc[3] on the third motor following the relational expression Uc[3]=U[3], based on the tension control input U[1], the tension control input U[2], and the state control input U[3].

5. A sheet processing system comprising:

a plurality of rollers for conveying a sheet, the plurality of rollers being arranged apart from each other along a conveyance path for the sheet;

a plurality of processing devices provided respectively between the plurality of rollers along the conveyance path for the sheet, each of the plurality of processing devices being configured to carry out a predetermined process on the sheet;

a plurality of motors provided to correspond respectively to the plurality of rollers, each of the plurality of motors being configured to rotationally drive the corresponding one roller among the plurality of rollers;

a plurality of measuring devices provided to correspond respectively to the plurality of rollers, each of the plurality of measuring devices being configured to measure a state quantity related to a rotating motion of the corresponding one roller among the plurality of rollers; and a controller configured to control, via the plurality of motors, an operation of transporting the sheet by rotation of the plurality of rollers, wherein the controller is configured to carry out processes of:

determining a control input on each of the plurality of motors;

inputting a drive signal according to the determined control input to each of the plurality of motors;

calculating, for each of the rollers, an estimated reaction force value which is an estimated value of a reaction force acting on the roller, based on the state quantity measured by the measuring device corresponding to the roller among the plurality of measuring devices, and the determined control input on the roller;

calculating, for each pair of adjacent rollers among the plurality of rollers, an estimated tension value which is an estimated value of a sheet tension exerted on the pair, based on the estimated reaction force value for the pair;

calculating, for each pair, a tension control input which is a control input for controlling the sheet tension exerted on the pair under a target tension, based on a deviation between the target tension and the estimated tension value for the pair; and calculating a state control input which is a control input for controlling the state quantity of one particular roller under a target state quantity, among the plurality of rollers, based on the target state quantity and the state quantity measured by the measuring device corresponding to the particular roller among the plurality of measuring devices, wherein upon determining the control input on each of the plurality of motors, the controller determines the control input on each of the plurality of motors based on the calculated tension control input for each pair, and the calculated state control input on the particular roller.

6. The sheet processing system according to claim 5, wherein the sheet processing system is configured to form an image on the sheet by carrying out a plurality of processes, and each of the plurality of processing devices is configured to carry out a process assigned to itself among the plurality of processes as the predetermined process.

7. The sheet processing system according to claim 6, wherein the sheet processing system is configured to form the image on the sheet by carrying out the plurality of processes in which a plurality of types of liquid droplets are jetted onto the sheet, and each of the plurality of processing devices is configured to carry out a process of jetting the type of liquid droplets assigned to itself onto the sheet among the plurality of types of liquid droplets, as the predetermined process.

8. A controller controlling an operation of transporting a sheet by controlling a plurality of motors provided to correspond respectively to a plurality of rollers in a conveyance mechanism conveying the sheet by rotation of the plurality of rollers arranged apart from each other along a conveyance path for the sheet, the controller being configured to carry out processes of:

determining a control input on each of the plurality of motors;

inputting a drive signal according to the determined control input to each of the plurality of motors;

calculating, for each of the rollers, an estimated reaction force value which is an estimated value of a reaction force acting on the roller, based on a state quantity measured by a measuring device corresponding to the roller among a plurality of measuring devices, and the control input on the roller determined in the determining process;

calculating, for each pair of adjacent rollers among the plurality of rollers, an estimated tension value which is an estimated value of a sheet tension exerted on the pair, based on the estimated reaction force value for the pair;

calculating, for each pair, a tension control input which is a control input for controlling the sheet tension exerted on the pair under a target tension, based on a deviation between the target tension and the estimated tension value for the pair; and calculating a state control input which is a control input for controlling the state quantity of one particular roller under a target state quantity, among the plurality of rollers, based on the target state quantity and the state quantity measured by the measuring device corresponding to the particular roller among the plurality of measuring devices, wherein in the process of determining the control input on each of the plurality of motors, the controller determines the control input on each of the plurality of motors based on the calculated tension control input for each pair, and the calculated state control input on the particular roller.

9. The controller according to claim 8, wherein upon estimating the tension value, the controller calculates, for each pair, the estimated tension value T[i] for the pair as a difference value $T[i]=R[i]-R[i+1]$ between the estimated reaction force values for the adjacent rollers corresponding to the pair (where i is an integer satisfying $1 \le i \le M-1$, M is the number of the plurality of rollers, T[i] denotes the estimated tension value for the pair of the ith roller and the (i+1)th roller among the plurality of rollers, R[i] denotes the estimated reaction force value for the ith roller, and R[i+1] denotes the estimated reaction force value for the (i+1)th roller); and the controller determines the control input Uc[j] on each of the plurality of motors, following the next relational expression:

$$\begin{bmatrix} Uc[1] \\ Uc[2] \\ \vdots \\ Uc[M-1] \\ Uc[M] \end{bmatrix} = Q^{-1} \cdot \begin{bmatrix} U[1] \\ U[2] \\ \vdots \\ U[M-1] \\ Uz \end{bmatrix}$$ [Formula 2]

based on the calculated tension control input U[i] for each pair, and the calculated state control input Uz, wherein U[i] denotes the tension control input for the pair of the ith roller and the (i+1)th roller, i is an integer satisfying $1 \leq i \leq M-1$, Uc[j] denotes the control input on the motor rotationally driving the jth roller among the plurality of motors, j is an integer satisfying $1 \leq j \leq M$, the matrix $Q^{-1}$ denotes the inverse of the matrix Q, the matrix Q is a matrix of M lines and M columns, and if the particular roller is the kth roller (where k is an integral value from 1 to M), then in the matrix Q, the element of the mth line and the mth column has the value of 1, the element of the mth line and the (m+1)th column has the value of −1, the element of the Mth line and the kth column has the value 1, and the other elements have the value of 0, in the range of m<M.

* * * * *